US007368002B2

(12) United States Patent
McDonnell et al.

(10) Patent No.: US 7,368,002 B2
(45) Date of Patent: May 6, 2008

(54) IONIC AIR CONDITIONING SYSTEM

(76) Inventors: Joseph A. McDonnell, 3744 Pine Lake Dr., Weston, FL (US) 33332; Gary D. Yacura, 19912 Interlachen Cir., Ashburn, VA (US) 20147; Gregory P. Brummett, 3210 Ravenscraig Ct., Oak Hill, VA (US) 20171

( * ) Notice: Subject to any disclaimer, the term of this patent is extended or adjusted under 35 U.S.C. 154(b) by 160 days.

(21) Appl. No.: 11/056,238

(22) Filed: Feb. 14, 2005

(65) Prior Publication Data

US 2006/0180027 A1 Aug. 17, 2006

(51) Int. Cl.
*B03C 3/40* (2006.01)

(52) U.S. Cl. ..... 96/39; 96/51; 96/94; 96/97; 96/98

(58) Field of Classification Search ..... 96/29, 96/39–42, 51, 94, 96, 97, 98–100, 95; 95/74–77; 422/186.04
See application file for complete search history.

(56) References Cited

U.S. PATENT DOCUMENTS

| | | | | |
|---|---|---|---|---|
| 434,483 | A | 8/1890 | Simonds | 384/543 |
| 4,789,801 | A | 12/1988 | Lee | 310/308 |
| 5,248,324 | A * | 9/1993 | Hara | 96/37 |
| 5,433,772 | A * | 7/1995 | Sikora | 96/87 |
| 5,601,636 | A * | 2/1997 | Glucksman | 96/63 |
| 6,176,977 | B1 | 1/2001 | Taylor et al. | 204/176 |
| 6,350,417 | B1 | 2/2002 | Lau et al. | 422/186.04 |
| 6,632,407 | B1 | 10/2003 | Lau et al. | 422/186 |
| 6,709,484 | B2 * | 3/2004 | Lau et al. | 95/76 |
| 6,713,026 | B2 | 3/2004 | Taylor et al. | 422/186.04 |
| 6,855,190 | B1 * | 2/2005 | Nikkhah | 96/51 |
| 6,908,501 | B2 * | 6/2005 | Reeves et al. | 96/29 |
| 7,077,890 | B2 * | 7/2006 | Botvinnik | 96/69 |
| 7,097,695 | B2 * | 8/2006 | Lau et al. | 96/29 |
| 7,150,780 | B2 * | 12/2006 | Krichtafovitch et al. | 96/72 |
| 7,179,432 | B2 * | 2/2007 | Hsieh | 422/186.04 |
| 2003/0206840 | A1 * | 11/2003 | Taylor et al. | 422/186.04 |
| 2003/0233935 | A1 * | 12/2003 | Reeves et al. | 95/76 |
| 2005/0051028 | A1 * | 3/2005 | Botvinnik | 96/88 |
| 2005/0051420 | A1 * | 3/2005 | Botvinnik | 204/164 |
| 2005/0232831 | A1 * | 10/2005 | Taylor et al. | 422/186.04 |
| 2006/0016333 | A1 * | 1/2006 | Taylor et al. | 95/76 |
| 2006/0018807 | A1 * | 1/2006 | Taylor et al. | 422/186.3 |
| 2006/0018808 | A1 * | 1/2006 | Taylor et al. | 422/186.04 |
| 2006/0018809 | A1 * | 1/2006 | Taylor et al. | 422/186.04 |
| 2006/0018810 | A1 * | 1/2006 | Taylor et al. | 422/186.04 |
| 2006/0018811 | A1 * | 1/2006 | Taylor et al. | 422/186.04 |
| 2007/0148061 | A1 * | 6/2007 | Lau et al. | 422/186.04 |

* cited by examiner

*Primary Examiner*—Richard L. Chiesa
(74) *Attorney, Agent, or Firm*—Harness, Dickey & Pierce, PLC

(57) ABSTRACT

The air conditioning system includes a housing having a vent portion and an ion generating unit positioned in the housing. The ion generating unit includes a first electrode, at least one second electrode, and a voltage generator that provides a constant potential difference between the first electrode and the second electrode. The second electrode is removable through a bottom surface of the housing from a resting position within the housing to a location external to the housing, and the second electrode is returnable through the bottom surface of the housing.

14 Claims, 23 Drawing Sheets

IONIC AIR CONDITIONING SYSTEM

BACKGROUND OF THE INVENTION

The use of an electric motor to rotate a fan blade to create an air flow has long been known in the art. Unfortunately, such fans produce substantial noise, and can present a hazard to children who may be tempted to poke a finger or a pencil into the moving fan blade. Although such fans can produce substantial air flow, e.g., 1,000 $ft^3$/minute or more, substantial electrical power is required to operate the motor, and essentially no conditioning of the flowing air occurs.

It is known to provide such fans with a HEPA-compliant filter element to remove particulate matter larger than perhaps 0.3 micrometers. Unfortunately, the resistance to air flow presented by the filter element may require doubling the electric motor size to maintain a desired level of airflow. Further, HEPA-compliant filter elements are expensive, and can represent a substantial portion of the sale price of a HEPA-compliant filter-fan unit. While such filter-fan units can condition the air by removing large particles, particulate matter small enough to pass through the filter element is not removed, including bacteria, for example.

It is also known in the art to produce an air flow using electro-kinetic techniques, by which electrical power is directly converted into a flow of air without mechanically moving components. One such system is described in U.S. Pat. No. 4,789,801 to Lee (1988), depicted herein in simplified form as FIGS. 1A and 1B. Lee's system 10 includes an array of small area ("minisectional") electrodes 20 that is spaced-apart symmetrically from an array of larger area ("maxisectional") electrodes 30. The positive terminal of a generator 40 that outputs a train of high voltage pulses (e.g., 0 to perhaps +5 kV) is coupled to the minisectional array, and the negative generator terminal is coupled to the maxisectional array.

The high voltage pulses ionize the air between the arrays, and an air flow 50 from the minisectional array toward the maxisectional array results, without requiring any moving parts. Particulate matter 60 in the air is entrained within the airflow 50 and also moves towards the maxisectional electrodes 30. Much of the particulate matter is electrostatically attracted to the surface of the maxisectional electrode array, where it remains, thus conditioning the flow of air exiting system 10. Further, the high voltage field present between the electrode arrays can release ozone into the ambient environment, which appears to destroy or at least alter whatever is entrained in the airflow, including for example, bacteria.

SUMMARY OF THE INVENTION

The present invention provides an ionic air condition.

In one embodiment, the ionic air conditioner includes a housing having a vent portion and an ion generating unit positioned in the housing. The ion generating unit includes a first electrode, at least one second electrode, and a voltage generator that provides a constant potential difference between the first electrode and the second electrode. The second electrode is removable through a bottom surface of the housing from a resting position within the housing to a location external to the housing, and the second electrode is returnable through the bottom surface of the housing.

In another embodiment, the ionic air conditioner includes a housing having a vent portion and an ion generating unit positioned in the housing. The ion generating unit includes a first electrode, at least one second electrode, and a voltage generator that provides a constant potential difference between the first electrode and the second electrode. The second electrode is removable through a side surface of the housing from a resting position within the housing to a location external to the housing such that gravity does not assist with removing the second electrode, and the second electrode is returnable through the side surface of the housing such that gravity does not assist with returning the second electrode.

BRIEF DESCRIPTION OF THE DRAWINGS

The present invention will become more fully understood from the detailed description given herein below and the accompanying drawings which are given by way of illustration only, wherein like reference numerals designate corresponding parts in the various drawings, and wherein.

DETAILED DESCRIPTION OF THE EXAMPLE EMBODIMENTS

Figure 1A:
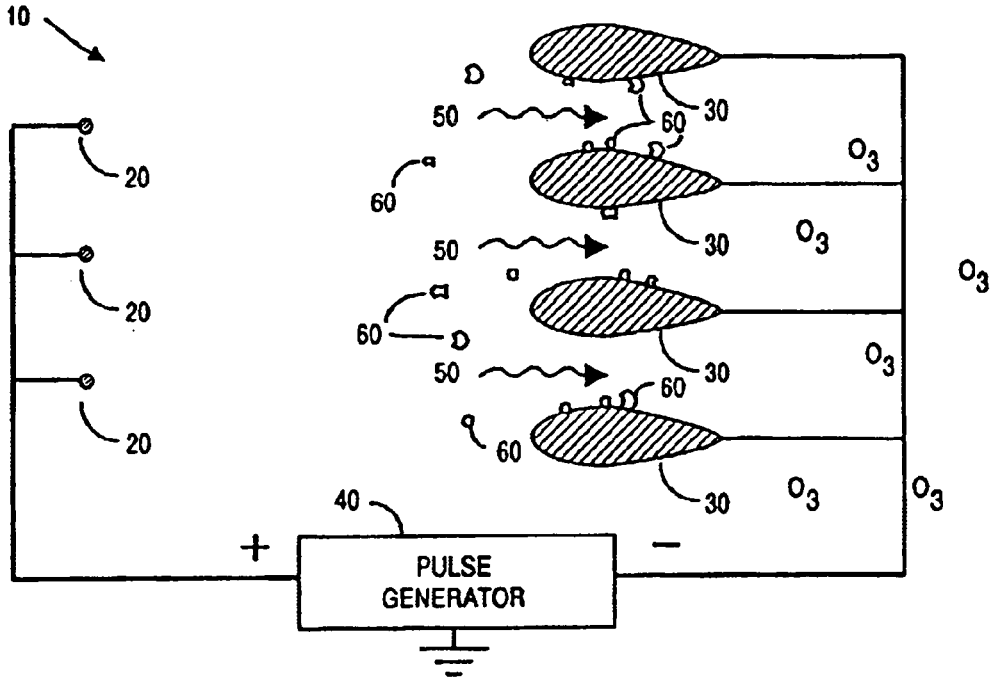
FIG. 1A (PRIOR ART)
FIG. 1A is a plan, cross-sectional view, of a first embodiment of a prior art electro-kinetic air transporter-conditioner system, according to the prior art.
Figure 1B:
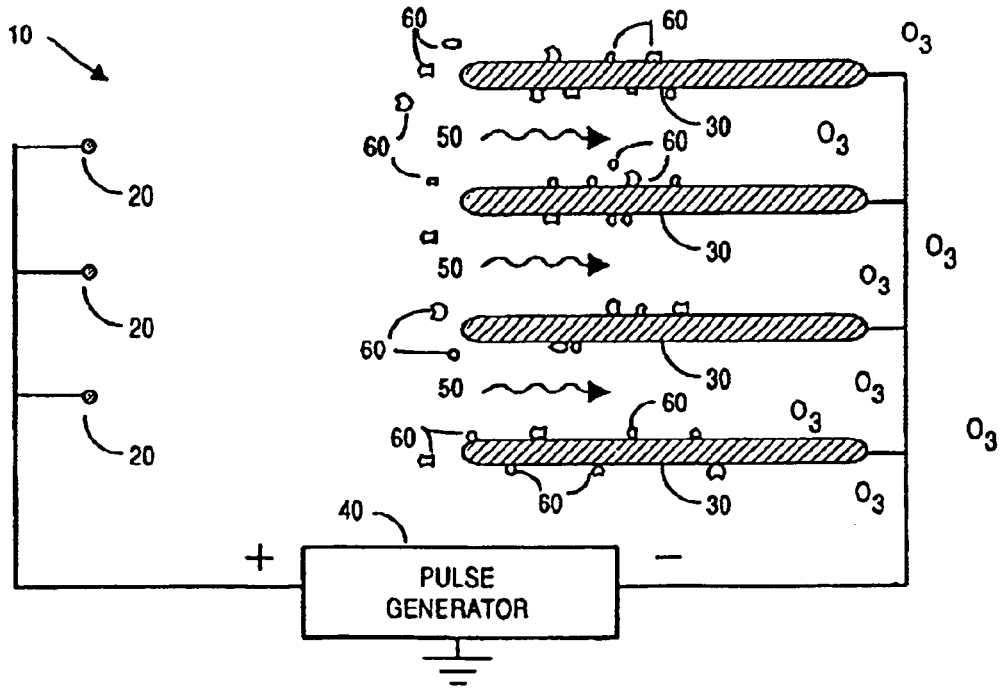
FIG. 1B (PRIOR ART)
FIG. 1B is a plan, cross-sectional view, of a second embodiment of a prior art electro-kinetic air transporter-conditioner system, according to the prior art.
Figure 2A:
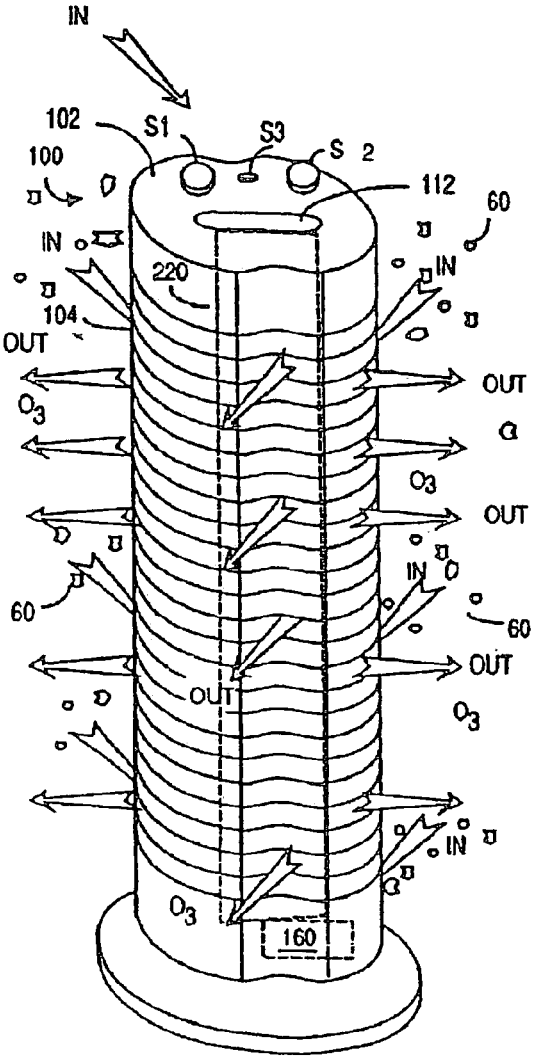
FIG. 2A PRIOR ART
FIG. 2A is a perspective view of a prior art device usable with current example embodiments.
Figure 2B:
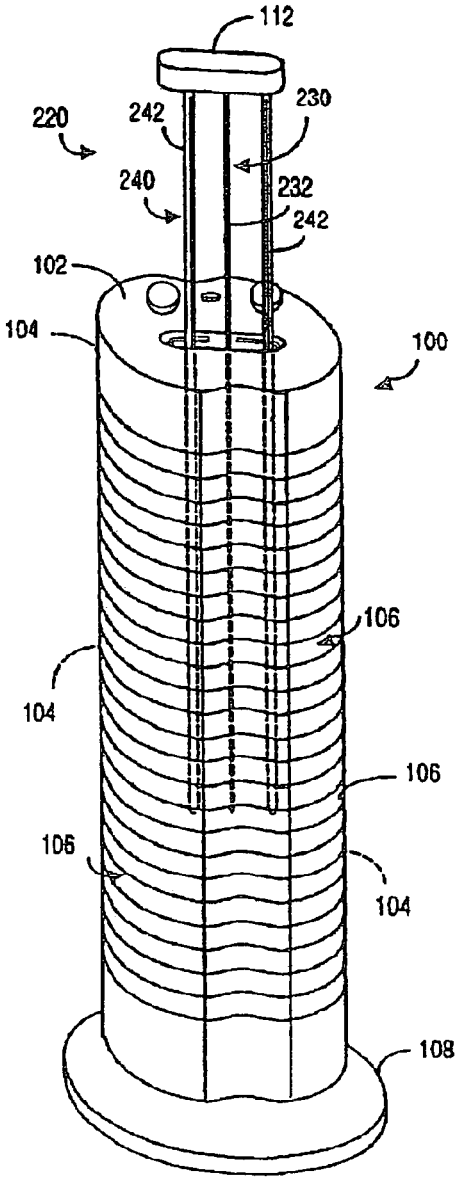
FIG. 2B PRIOR ART
FIG. 2B is a perspective view of the device of FIG. 2A, with the electrode assembly partially withdrawn.

FIGS. 2A and 2B depict an electro-kinetic air transporter-conditioner system 100 whose housing 102 includes rear-located intake vents or louvers 104 and front and side-located exhaust vents 106, and a base pedestal 108. Internal to the transporter housing is an ion generating unit 160, which may be powered by an AC:DC power supply that is energizable using switch S1 (see FIG. 3). Ion generating unit 160 is self-contained in that other than ambient air, nothing is required from beyond the transporter housing, save external operating potential, for operation of the present invention.

Figure 3:
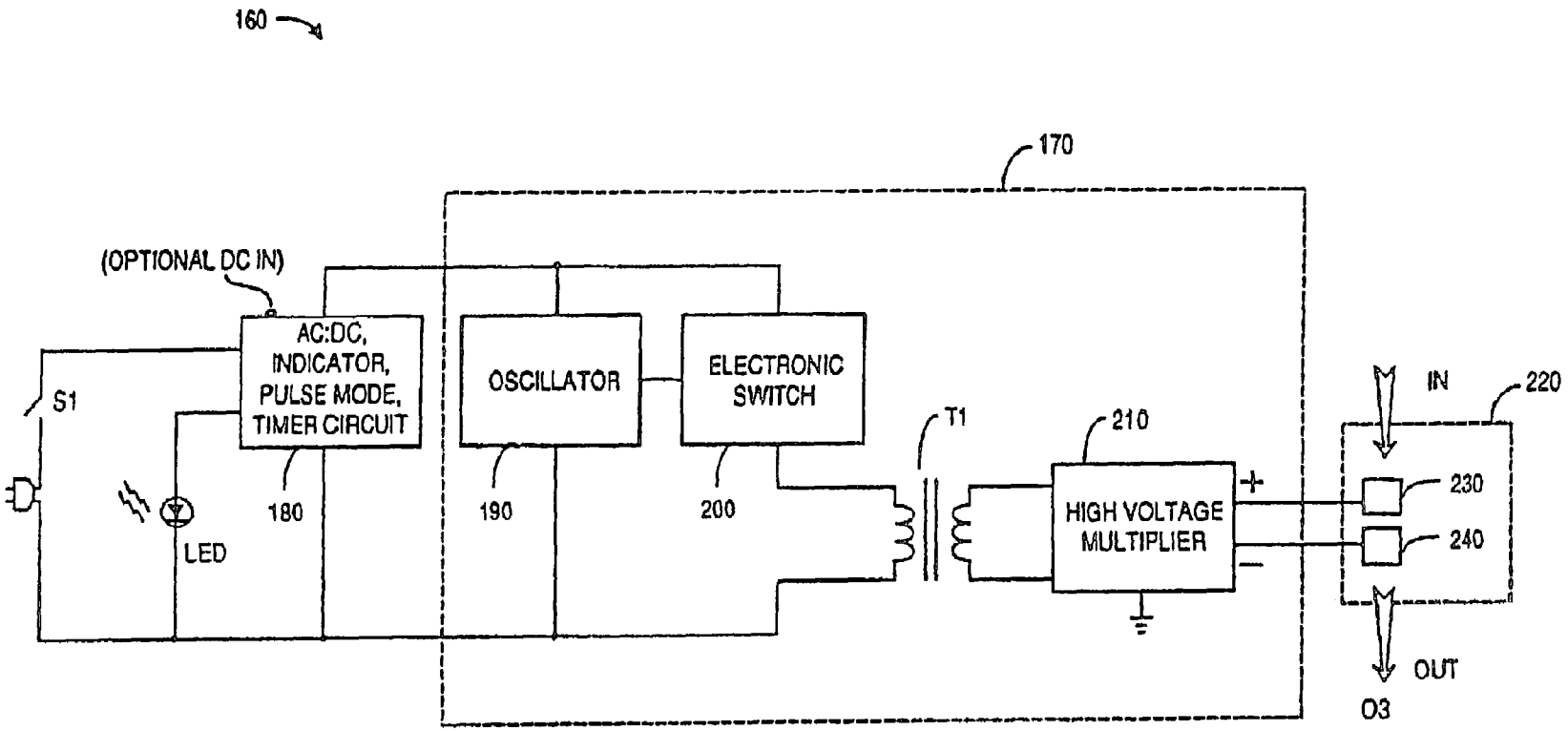
FIG. 3 PRIOR ART
FIG. 3 is an electrical block diagram of a prior art device useable with current example embodiments.

The upper surface of housing 102 includes a user-liftable handle 112 to which is affixed an electrode assembly 220 that comprises a first array 230 of electrodes 232 and a second array 240 of electrodes 242. The first and second arrays of electrodes are coupled in series between the output terminals of ion generating unit 160, as best seen in FIG. 3. The ability to lift handle 112 provides ready access to the electrodes comprising the electrode assembly, for purposes of cleaning and, if necessary, replacement.

There need be no real distinction between vents 104 and 106, except their location relative to the second array electrodes, and indeed a common vent could be used. These vents serve to ensure that an adequate flow of ambient air may be drawn into or made available to the present invention.

As will be described, when unit 100 is energized with S1, high voltage output by ion generator 160 produces ions at the first electrode array, which ions are attracted to the second electrode array. The movement of the ions in an "IN" to "OUT" direction carries with them air molecules, thus electrokinetically producing an outflow of ionized air. The "IN" notion in FIGS. 2A and 2B denote the intake of ambient air with particulate matter 60. The "OUT" notation in the figures denotes the outflow of cleaned air substantially devoid of the particulate matter, which adheres electrostatically to the surface of the second array electrodes. It may be desired to provide the inner surface of housing 102 with an electrostatic shield to reduces detectable electromagnetic radiation. For example, a metal shield could be disposed within the housing, or portions of the interior of the housing could be coated with a metallic paint to reduce such radiation.

As best seen in FIG. 3, ion generating unit 160 includes a high voltage generator unit 170 and circuitry 180 for converting raw alternating voltage (e.g., 120 VAC) into direct current ("DC") voltage. Circuitry 180 includes circuitry controlling the shape and/or duty cycle of the generator unit output voltage (which control is altered with user switch S2). Circuitry 180 also includes a pulse mode component, coupled to switch S3, to temporarily provide a burst of increased output ozone. Circuitry 180 can also include a timer circuit and a visual indicator such as a light emitting diode ("LED"). The LED or other indicator (including, if desired, audible indicator) signals when ion generation is occurring. The timer can automatically halt generation of ions and/or ozone after some predetermined time, e.g., 30 minutes. indicator(s), and/or audible indicator(s).

As shown in FIG. 3, high voltage generator unit 170 comprises a low voltage oscillator circuit 190 of perhaps 20 kHz frequency, that outputs low voltage pulses to an electronic switch 200, e.g., a thyristor or the like. Switch 200 switchably couples the low voltage pulses to the input winding of a step-up transformer T1. The secondary winding of T1 is coupled to a high voltage multiplier circuit 210 that outputs high voltage pulses. The circuitry and components comprising high voltage generator 170 and circuit 180 are fabricated on a printed circuit board that is mounted within housing 102.

Output pulses from high voltage generator 170 may be at least 10 kV peak-to-peak with an effective DC offset of perhaps half the peak-to-peak voltage, and have a frequency of perhaps 20 kHz. The pulse train output may have a duty cycle of perhaps 10%, which will promote battery lifetime. Of course, different peak-peak amplitudes, DC offsets, pulse train waveshapes, duty cycle, and/or repetition frequencies may instead be used.

According to another embodiment, a 100% pulse train (e.g., an essentially DC high voltage) may be used. Namely, a constant voltage is applied by the generator unit 170. Thus, in this embodiment, the generator unit 170 may by a constant voltage generator.

The output from high voltage generator unit 170 is coupled to an electrode assembly 220 that comprises a first electrode array 230 and a second electrode array 240. Unit 170 functions as a DC:DC high voltage generator, and could be implemented using other circuitry and/or techniques to output high voltage pulses that are input to electrode assembly 220.

In the embodiment of FIG. 3, the positive output terminal of unit 170 is coupled to first electrode or array 230, and the negative output terminal is coupled to second electrode or array 240. An electrostatic flow of air is created, going from the first electrode array towards the second electrode array. (This flow is denoted "OUT" in the figures.) Accordingly electrode assembly 220 is mounted within transporter system 100 such that second electrode array 240 is closer to the OUT vents and first electrode array 230 is closer to the IN vents.

When a voltage from the high voltage generator 170 is coupled across first and second electrode arrays 230 and 240, it is believed that a plasma-like field is created surrounding electrodes 232 in first array 230. This electric field ionizes the ambient air between the first and second electrode arrays and establishes an "OUT" airflow that moves towards the second array. It is understood that the IN flow enters via vent(s) 104, and that the OUT flow exits via vent(s) 106.

Coupling an opposite polarity potential to the second array electrode(s) 242 may accelerate the motion of ions generated at the first array, producing the air flow denoted as "OUT" in the figures. As the ions move toward the second array, it is believed that they push or move air molecules toward the second array. The relative velocity of this motion may be increased by decreasing the potential at the second array relative to the potential at the first array.

As noted, outflow (OUT) includes safe amounts of ozone that can destroy or at least substantially alter bacteria, germs, and other living (or quasi-living) matter subjected to the outflow. Thus, when switch S1 is closed and B1 has sufficient operating potential, voltage from the high voltage generator unit 170 creates an outflow (OUT) of ionized air and ozone. When S1 is closed, an LED may visually signal when ionization is occurring.

In practice, unit 100 is placed in a room and connected to an appropriate source of operating potential, typically 117 VAC. With S1 energized, ionization unit 160 emits ionized air and may be some ozone ($O_3$) via outlet vents 150. The air flow, coupled with the ions and ozone freshens the air in the room, and the ozone can beneficially destroy or at least diminish the undesired effects of certain odors, bacteria, germs, and the like. The air flow is indeed electro-kinetically produced, in that there are no intentionally moving parts within the present invention. (As noted, some mechanical vibration may occur within the electrodes.)

Having described various aspects of the invention in general, embodiments of electrode assembly 220 will now be described. In the various embodiments, electrode assembly 220 may comprise a first array 230 of at least one electrode 232, and will further comprise a second array 240 of at least one electrode 242. Understandably material(s) for electrodes 232 and 242 should conduct electricity, be resilient to corrosive effects from the application of high voltage, yet be strong enough to be cleaned.

In the various electrode assemblies to be described herein, electrode(s) 232 in the first electrode array 230 may be fabricated from tungsten. Tungsten is sufficiently robust to withstand cleaning, has a high melting point to retard breakdown due to ionization, and has a rough exterior surface that seems to promote efficient ionization. On the other hand, electrodes 242 will have a highly polished exterior surface to minimize unwanted point-to-point radiation. As such, electrodes 242 may be fabricated from stainless steel, brass, among other materials. The polished surface of electrodes 232 also promotes ease of electrode cleaning.

The electrodes 232 and 242 according to the present invention are light weight, easy to fabricate, and lend themselves to mass production. Further, electrodes 232 and 242 described herein promote more efficient generation of ionized air.

In the present invention, a high voltage generator 170 is coupled between the first electrode array 230 and the second electrode array 240. The high voltage produces a flow of ionized air that travels in the direction from the first array towards the second array (indicated herein by hollow arrows denoted "OUT"). As such, electrode(s) 232 may be referred to as an emitting electrode, and electrodes 242 may be referred to as collector electrodes.

According to the present invention, the positive output terminal or port of the high voltage generator 170 may be coupled to electrodes 232, and that the negative output terminal or port be coupled to electrodes 242. It is believed that the net polarity of the emitted ions is positive, e.g., more positive ions than negative ions are emitted.

Figure 4A:
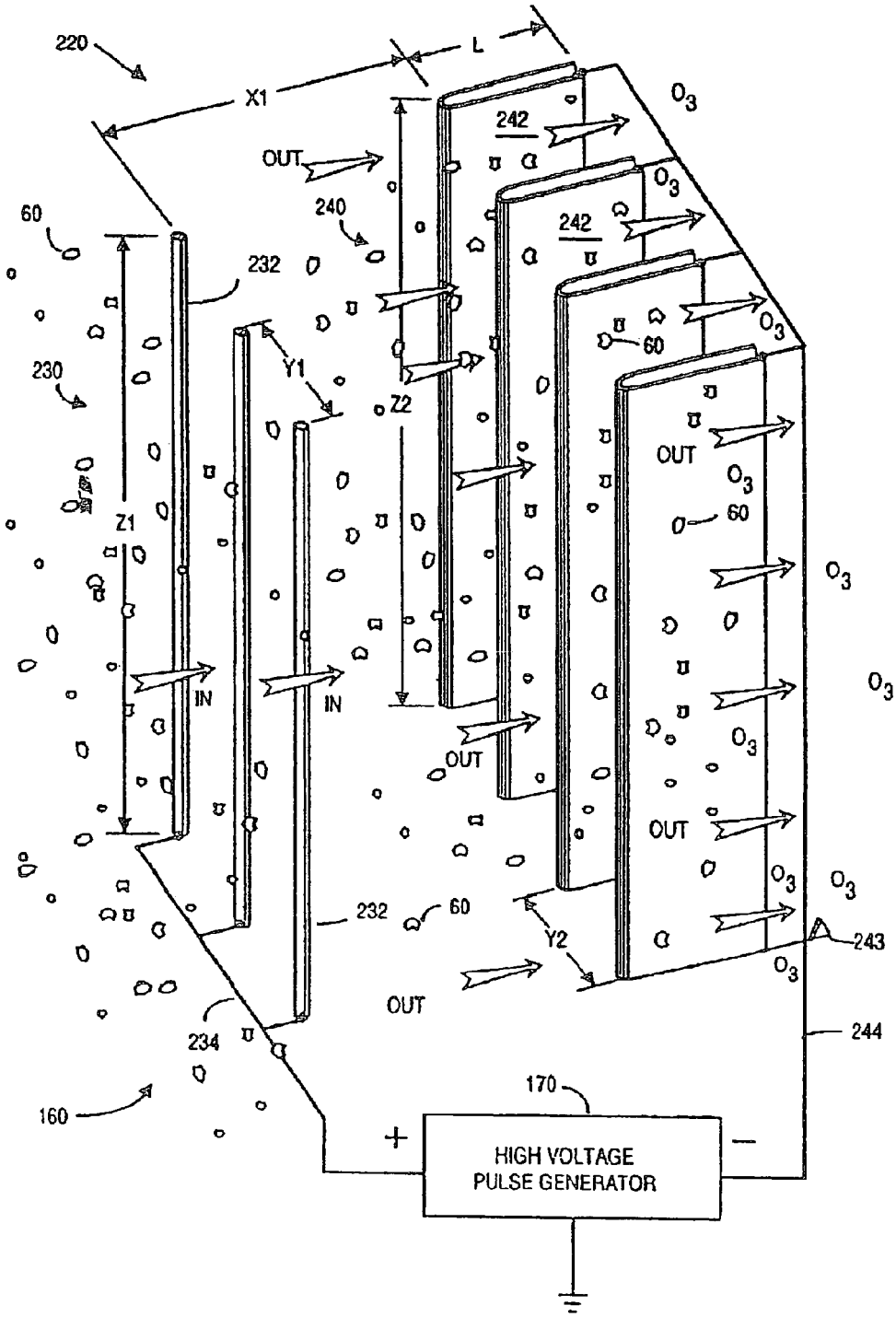
FIG. 4A PRIOR ART
FIG. 4A is a perspective block diagram showing a prior art device for an electrode assembly usable with current example embodiments.
Figure 4B:
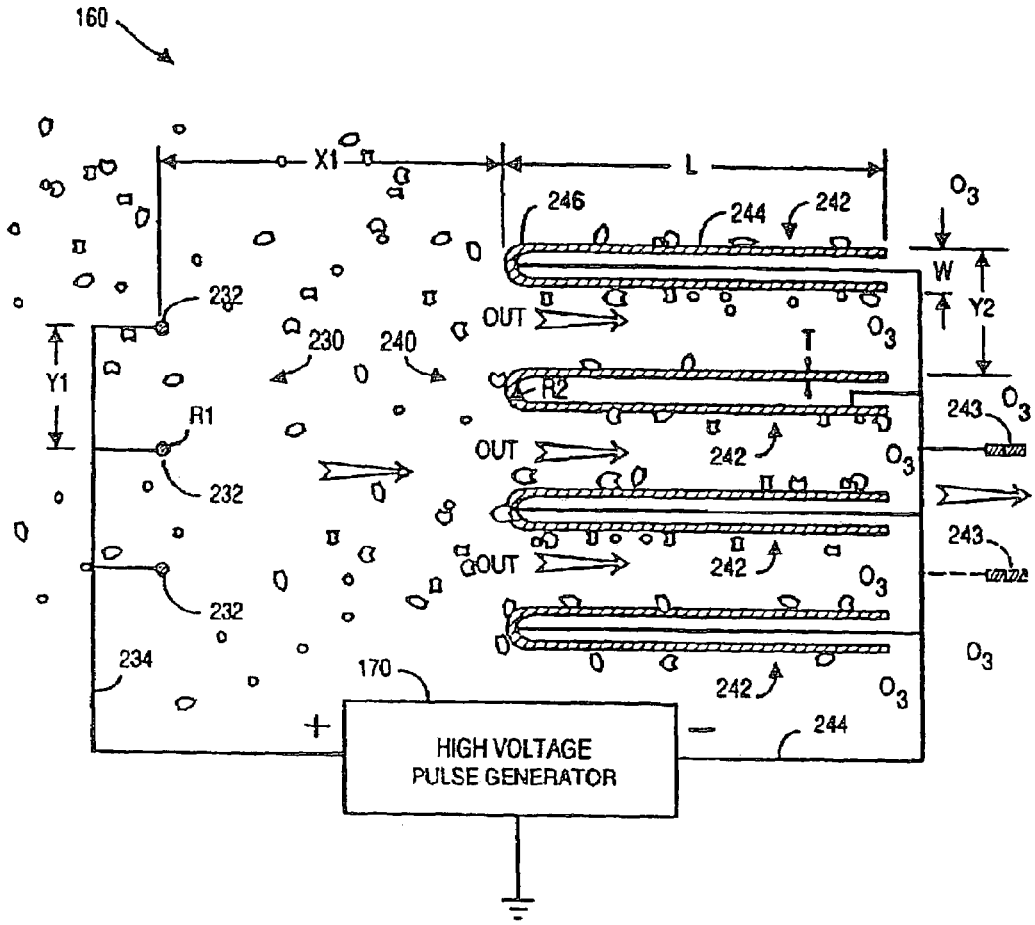
FIG. 4B PRIOR ART
FIG. 4B is a plan block diagram of the device of FIG. 4A.

Turning now to the embodiments of FIGS. 4A and 4B, the electrode assembly 220 may comprise a first array 230 of wire electrodes 232, and a second array 240 of generally U-shaped electrodes 242. the number N1 of electrodes comprising the first array will differ by one relative to the number N2 of electrodes comprising the second array. In many of the embodiments shown, N2>N1. However, if desired, in FIG. 4A, additional first electrodes 232 may be added at the out ends of array 230 such that N1>N2, e.g., five electrodes 232 compared to four electrodes 242.

Electrodes 232 may be lengths of tungsten wire, whereas electrodes 242 may be formed from sheet metal, stainless steel, although brass or other sheet metal could be used. The sheet metal is readily formed to define side regions 244 and bulbous nose region 246 for hollow elongated U shaped electrodes 242. While FIG. 4A depicts four electrodes 242 in second array 240 and three electrodes 232 in first array 230, as noted, other numbers of electrodes in each array could be used, retaining a symmetrically staggered configuration as shown. It is seen in FIG. 4A that while particulate matter 60 is present in the incoming (IN) air, the outflow (OUT) air is substantially devoid of particulate matter, which adheres to the large surface area provided by the second array electrodes (see FIG. 4B).

As best seen in FIG. 4B, the spaced-apart configuration between the arrays is staggered such that each first array electrode 232 is substantially equidistant from two second array electrodes 242. This symmetrical staggering has been found to be an especially efficient electrode placement. The staggering geometry is symmetrical in that adjacent electrodes 232 or adjacent electrodes 242 are spaced-apart a constant distance, Y1 and Y2 respectively. However, a non-symmetrical configuration could also be used. Also, it is understood that the number of electrodes 232 and 242 may differ from what is shown.

In FIG. 4A, typically dimensions are as follows: diameter of electrodes 232 is about 0.08 mm, distances Y1 and Y2 are each about 16 mm, distance X1 is about 16 mm, distance L is about 20 mm, and electrode heights Z1 and Z2 are each about 1 m. The width W of electrodes 242 is about 4 mm, and the thickness of the material from which electrodes 242 are formed is about 0.5 mm. Of course other dimensions and shapes could be used. The electrodes 232 may be small in diameter to help establish a desired high voltage field.

Electrodes 232 in first array 230 are coupled by a conductor 234 to a first (positive) output port of high voltage generator 170, and electrodes 242 in second array 240 are coupled by a conductor 244 to a second (ground or negative) output port of generator 170. It is relatively unimportant where on the various electrodes electrical connection is made to conductors 234 or 244. Thus, by way of example FIG. 4B depicts conductor 244 making connection with some electrodes 242 internal to bulbous end 246, while other electrodes 242 make electrical connection to conductor 244 elsewhere on the electrode. Electrical connection to the various electrodes 242 could also be made on the electrode external surface providing no substantial impairment of the outflow airstream results.

To facilitate removing the electrode assembly from unit 100 (as shown in FIG. 2B), the lower end of the various electrodes fit against mating portions of wire or other conductors 234 or 244. For example, "cup-like" members can be affixed to wires 234 and 244 into which the free ends of the various electrodes fit when electrode array 220 is inserted completely into housing 102 of unit 100.

The ratio of the effective electric field emanating area of electrode 232 to the nearest effective area of electrodes 242 may be at least about 15:1, and for example may be at least 20:1. Thus, in the embodiment of FIG. 4A and FIG. 4B, the ratio R2:R1~2 mm:0.04 mm~50:1.

Note the inclusion in FIGS. 4A and 4B of at least one output controlling electrode 243, electrically coupled to the same potential as the second array electrodes. Electrode 243 defines a pointed shape in side profile, e.g., a triangle. The sharp point on electrode(s) 243 causes generation of substantial negative ions (because the electrode is coupled to relatively negative high potential). These negative ions neutralize excess positive ions otherwise present in the output air flow, such that the OUT flow has a net negative charge. Electrode(s) 243 are stainless steel, copper, or other conductor, and are perhaps 20 mm high and about 12 mm wide at the base.

Figure 4C:
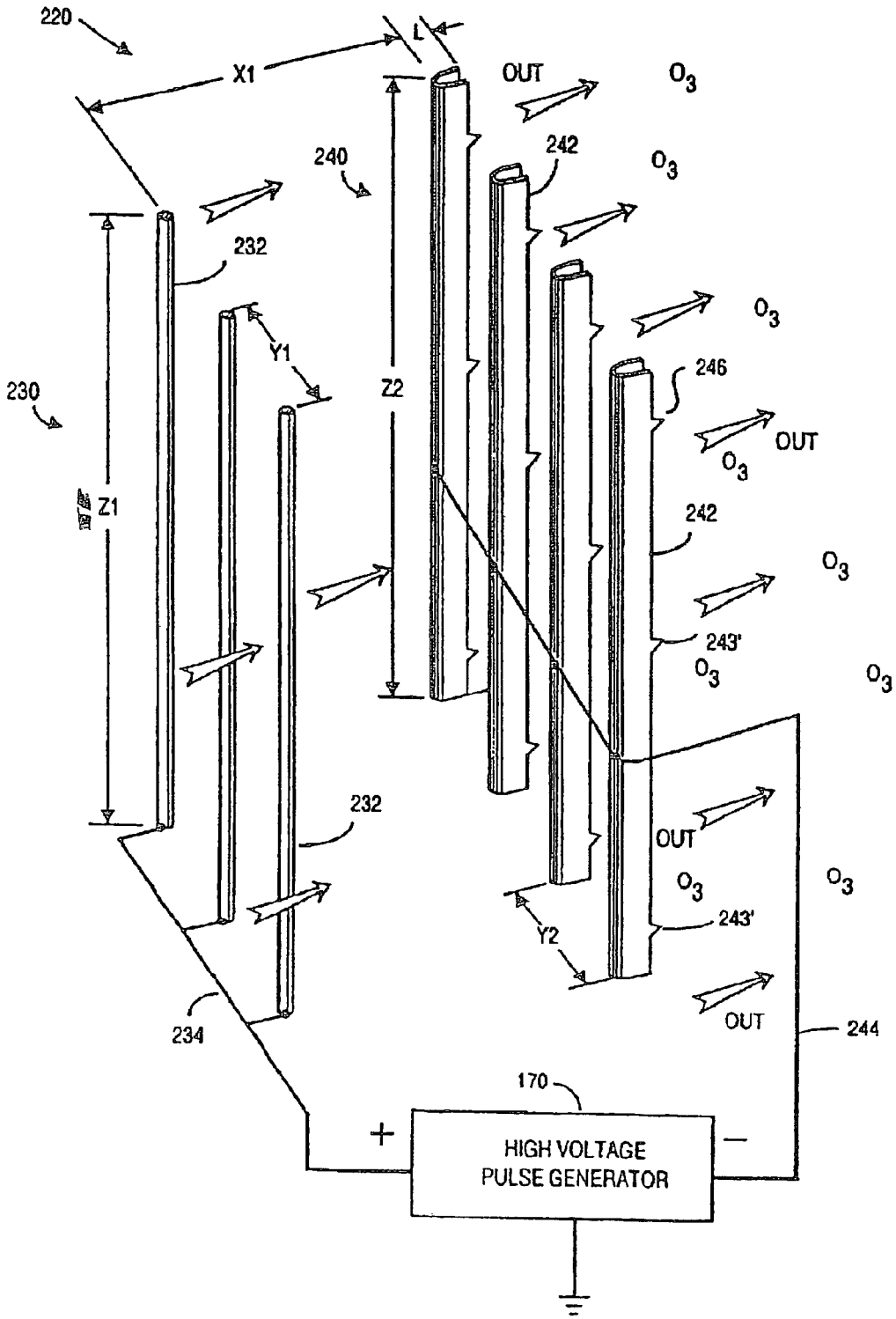
FIG. 4C PRIOR ART
FIG. 4C is a perspective block diagram showing a second prior art device for an electrode assembly usable with current example embodiments.

In the embodiment of FIGS. 4A and 4C, each U-shaped electrode 242 has two trailing edges that promote efficient kinetic transport of the outflow of ionized air and ozone. Note the inclusion on at least one portion of a trailing edge of a pointed electrode region 243'. Electrode region 243' helps promote output of negative ions, in the same fashion as was described with respect to FIGS. 4A and 4B. In FIG. 4C and the figures to follow, the particulate matter is omitted for ease of illustration. However, from what was shown in FIGS. 2A-4B, particulate matter will be present in the incoming air, and will be substantially absent from the outgoing air. As has been described, particulate matter 60 typically will be electrostatically precipitated upon the surface area of electrodes 242.

Figure 4D:
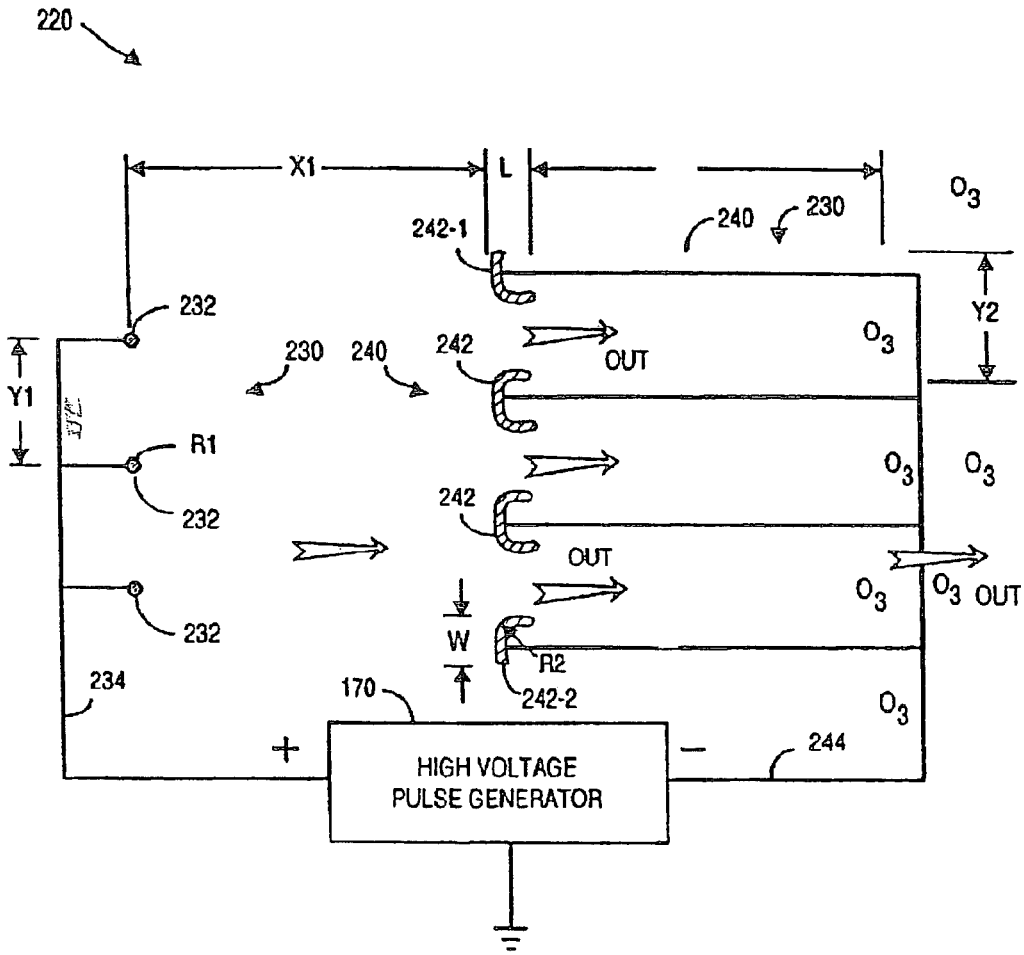
FIG. 4D PRIOR ART
FIG. 4D is a plan block diagram of a modified version of the device of FIG. 4C.

Note that the embodiments of FIGS. 4C and 4D depict somewhat truncated versions of electrodes 242. Whereas dimension L in the embodiment of FIGS. 4A and 4B was about 20 mm, in FIGS. 4C and 4D, L has been shortened to about 8 mm. Other dimensions in FIG. 4C are similar to those stated for FIGS. 4A and 4B. In FIGS. 4C and 4D, the inclusion of point-like regions 246 on the trailing edge of electrodes 242 seems to promote more efficient generation of ionized air flow. It will be appreciated that the configuration of second electrode array 240 in FIG. 4C can be more robust than the configuration of FIGS. 4A and 4B, by virtue of the shorter trailing edge geometry. As noted earlier, a symmetrical staggered geometry for the first and second electrode arrays is preferred for the configuration of FIG. 4C.

In the embodiment of FIG. 4D, the outermost second electrodes, denoted 242-1 and 242-2, have substantially no outermost trailing edges. Dimension L in FIG. 4D is about 3 mm, and other dimensions may be as stated for the configuration of FIGS. 4A and 4B. Again, the R2:R1 ratio for the embodiment of FIG. 4D exceeds about 20:1.

Figure 4E:
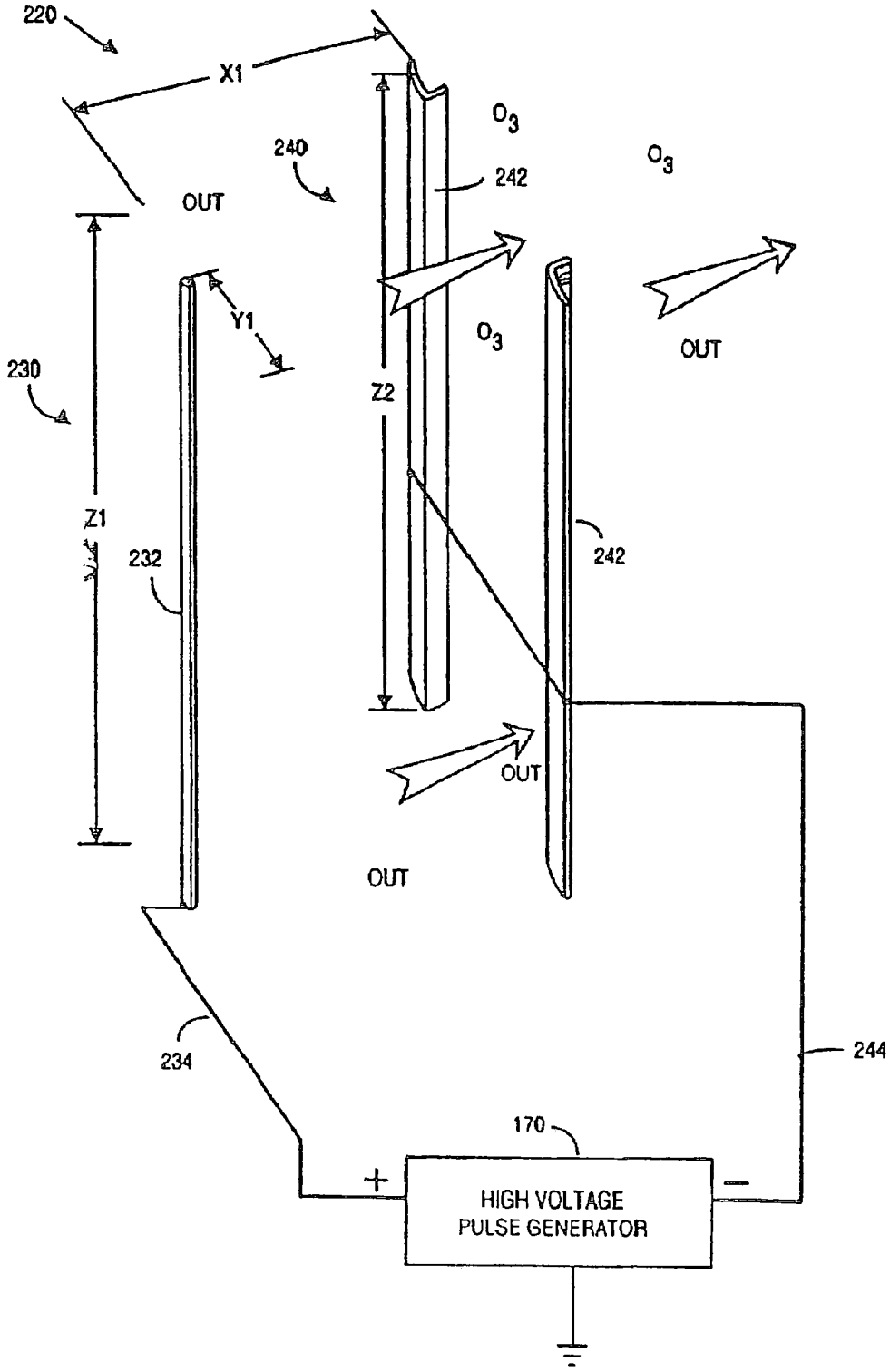
FIG. 4E PRIOR ART
FIG. 4E is a perspective block diagram showing a third prior art device for an electrode assembly usable with current example embodiments.
Figure 4F:
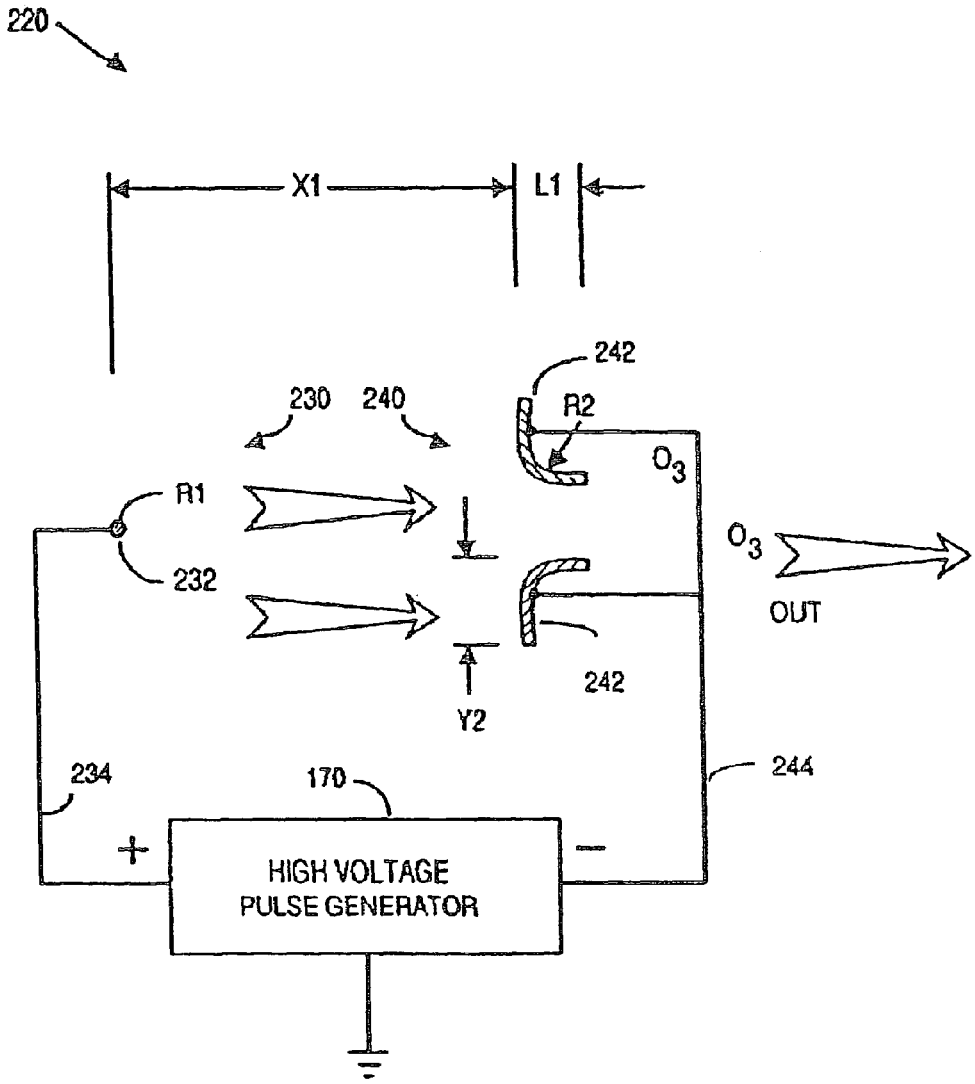
FIG. 4F PRIOR ART
FIG. 4F is a plan block diagram of the device of FIG. 4E.

FIGS. 4E and 4F depict another embodiment of electrode assembly 220, in which the first electrode array comprises a single wire electrode 232, and the second electrode array comprises a single pair of curved L-shaped electrodes 242, in cross-section. Typical dimensions, where different than what has been stated for earlier-described embodiments, are X1≈12 mm, Y1≈6 mm, Y2≈5 mm, and L1≈3 mm. The effective R2:R1 ratio is again greater than about 20:1. The fewer electrodes comprising assembly 220 in FIGS. 4E and 4F promote economy of construction, and ease of cleaning, although more than one electrode 232, and more than two electrodes 242 could of course be employed. This embodiment again incorporates the staggered symmetry described earlier, in which electrode 232 is equidistant from two electrodes 242.

Figure 4G:
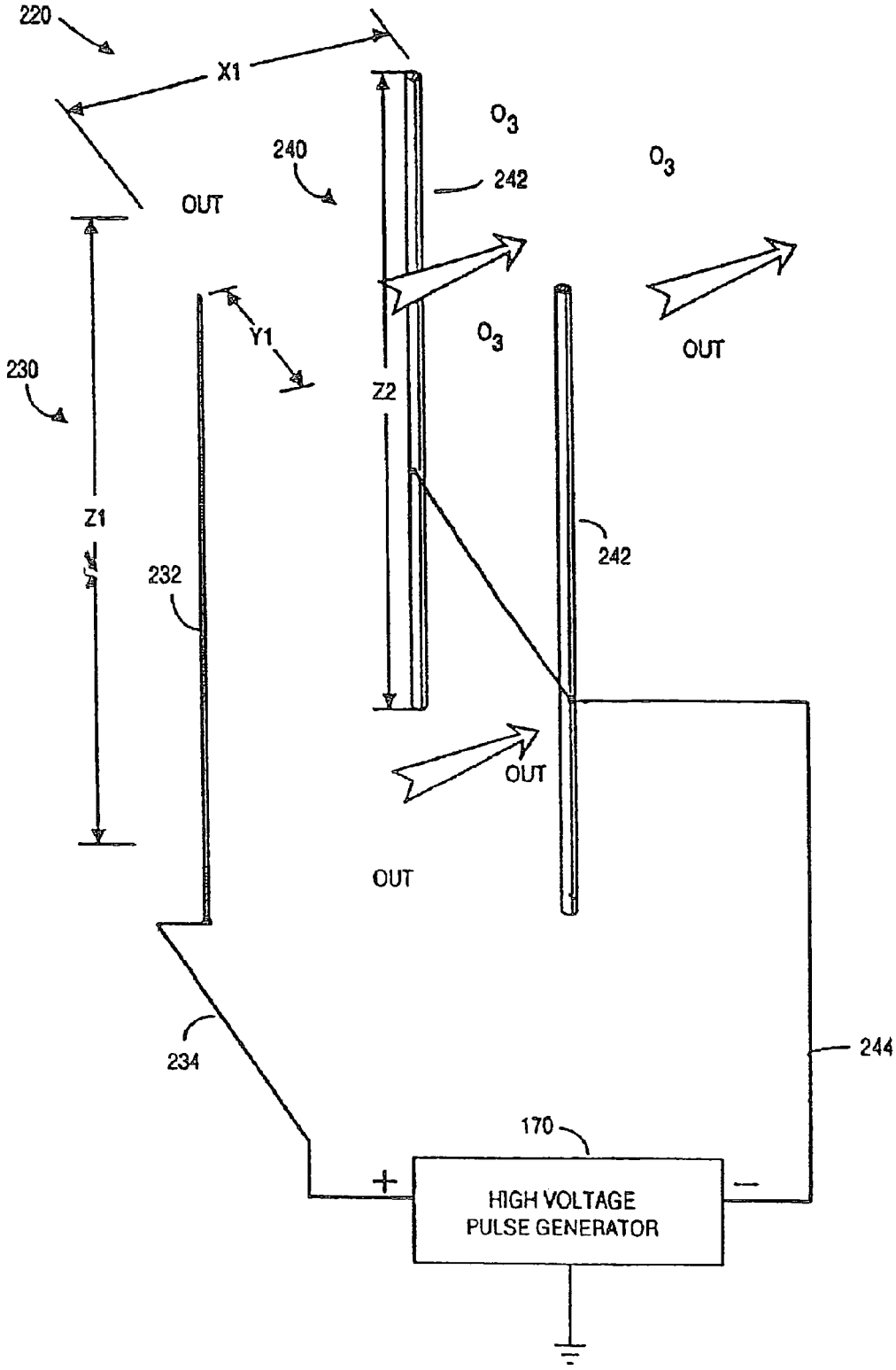
FIG. 4G PRIOR ART
FIG. 4G is a perspective block diagram showing a fourth prior art device for an electrode assembly usable with current example embodiments.
Figure 4H:
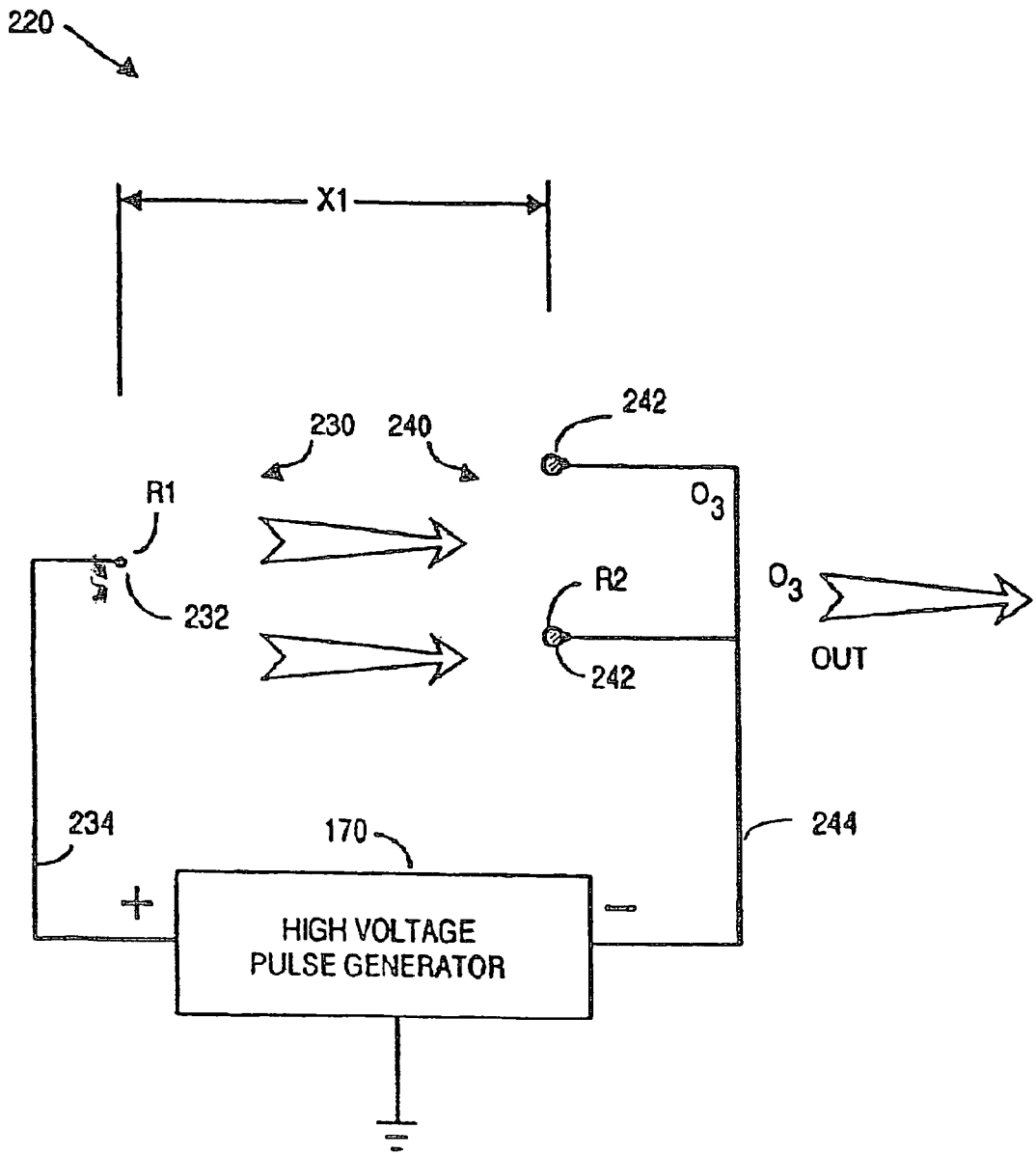
FIG. 4H PRIOR ART
FIG. 4H is a plan block diagram of the device of FIG. 4G.

FIGS. 4G and 4H shown yet another embodiment for electrode assembly 220. In this embodiment, first electrode array 230 is a length of wire 232, while the second electrode array 240 comprises a pair of rod or columnar electrodes 242. As in embodiments described earlier herein, the electrode 232 be symmetrically equidistant from electrodes 242. Wire electrode 232 is perhaps 0.08 mm tungsten, whereas columnar electrodes 242 are perhaps 2 mm diameter stainless steel. Thus, in this embodiment the R2:R1 ratio is about 25:1. Other dimensions may be similar to other configurations, e.g., FIGS. 4E, 4F. Of course electrode assembly 220 may comprise more than one electrode 232, and more than two electrodes 242.

Figure 4I:
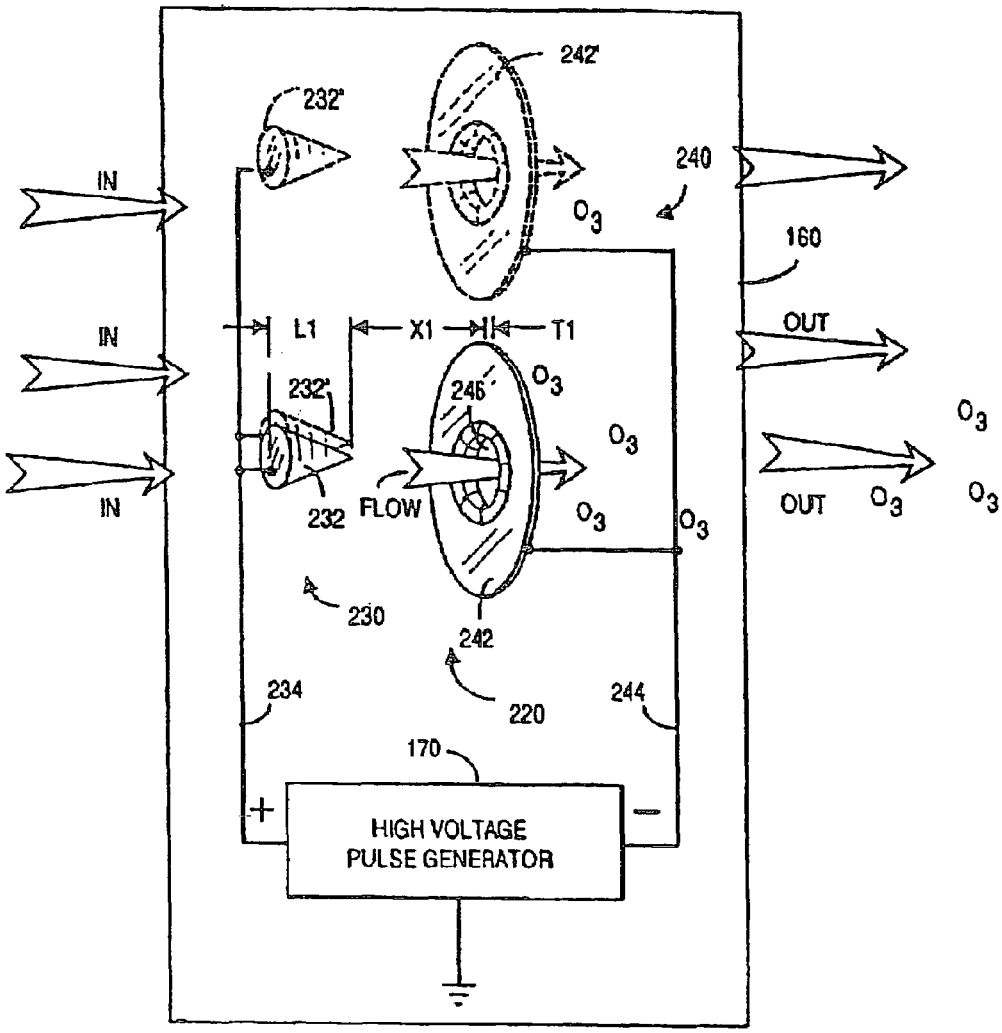
FIG. 4I is a perspective block diagram showing a fifth prior art device for an electrode assembly usable with current example embodiments.
Figure 4J:
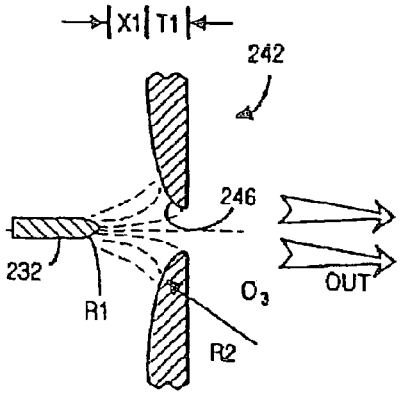
FIG. 4J PRIOR ART
FIG. 4J is a detailed cross-sectional view of a portion of the device of FIG. 4I.

Another embodiment is shown in FIG. 41 and FIG. 4J. In these figures, the first electrode assembly comprises a single pin-like element 232 disposed coaxially with a second electrode array that comprises a single ring-like electrode 242 having a rounded inner opening 246. However, as indicated by phantom elements 232', 242', electrode assembly 220 may comprise a plurality of such pin-like and ring-like elements. The electrode 232 is tungsten, and electrode 242 is stainless steel.

Typical dimensions for the embodiment of FIG. 4I and FIG. 4J are L1≈10 mm, X1≈9.5 mm, T≈0.5 mm, and the diameter of opening 246 is about 12 mm. Dimension L1 is sufficiently long that upstream portions of electrode 232 (e.g., portions to the left in FIG. 4I) do not interfere with the electrical field between electrode 232 and the collector electrode 242. However, as shown in FIG. 4J, the effect R2/R1 ratio is governed by the tip geometry of electrode 232. Again, in the preferred embodiment, this ratio exceeds about 20:1. Lines drawn in phantom in FIG. 4J depict theoretical electric force field lines, emanating from emitter electrode 232, and terminating on the curved surface of collector electrode 246. The bulk of the field emanates within about +/−45° of coaxial axis between electrode 232 and electrode 242. On the other hand, if the opening in electrode 242 and/or electrode 232 and 242 geometry is such that too narrow an angle about the coaxial axis exists, air flow will be unduly restricted.

One advantage of the ring-pin electrode assembly configuration shown in FIG. 4I is that the flat regions of ring-like electrode 242 provide sufficient surface area to which particulate matter 60 entrained in the moving air stream can attach, yet be readily cleaned.

Figure 4K:
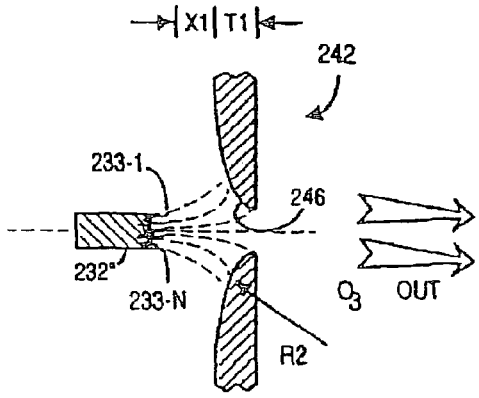
FIG. 4K PRIOR ART
FIG. 4K is a detailed cross-sectional view of a portion of an alternative to the device of FIG. 4I.

It will be appreciated that the first array pin electrodes may be utilized with the second array electrodes of FIGS. 4A-4H. Further, the second array ring electrodes may be utilized with the first array electrodes of FIGS. 4A-4H. For example, in modifications of the embodiments of FIGS. 4A-4H, each wire or columnar electrode 232 is replaced by a column of electrically series-connected pin electrodes (e.g., as shown in FIGS. 4I-4K), while retaining the second electrode arrays as depicted in these figures. By the same token, in other modifications of the embodiments of FIGS. 4A-4H, the first array electrodes can remain as depicted, but each of the second array electrodes 242 is replaced by a column of electrically series-connected ring electrodes (e.g., as shown in FIGS. 4I-4K).

In FIG. 4J, a detailed cross-sectional view of the central portion of electrode 242 in FIG. 4I is shown. As best seen in FIG. 4J, curved region 246 adjacent the central opening in electrode 242 appears to provide an acceptably large surface area to which many ionization paths from the distal tip of electrode 232 have substantially equal path length. Thus, while the distal tip (or emitting tip) of electrode 232 is advantageously small to concentrate the electric field between the electrode arrays, the adjacent regions of electrode 242 provide many equidistant inter-electrode array paths. A high exit flow rate of perhaps 90 feet/minute and 2,000 ppb range ozone emission attainable with this configuration confirm a high operating efficiency.

In FIG. 4K, one or more electrodes 232 is replaced by a conductive block 232" of carbon fibers, the block having a distal surface in which projecting fibers 233-1, . . . 233-N take on the appearance of a "bed of nails." The projecting fibers can each act as an emitting electrode and provide a plurality of emitting surfaces. Over a period of time, some or all of the electrodes will literally be consumed, whereupon graphite block 232" will be replaced. Materials other than graphite may be used for block 232" providing the material has a surface with projecting conductive fibers such as 233-N.

Figure 4L:
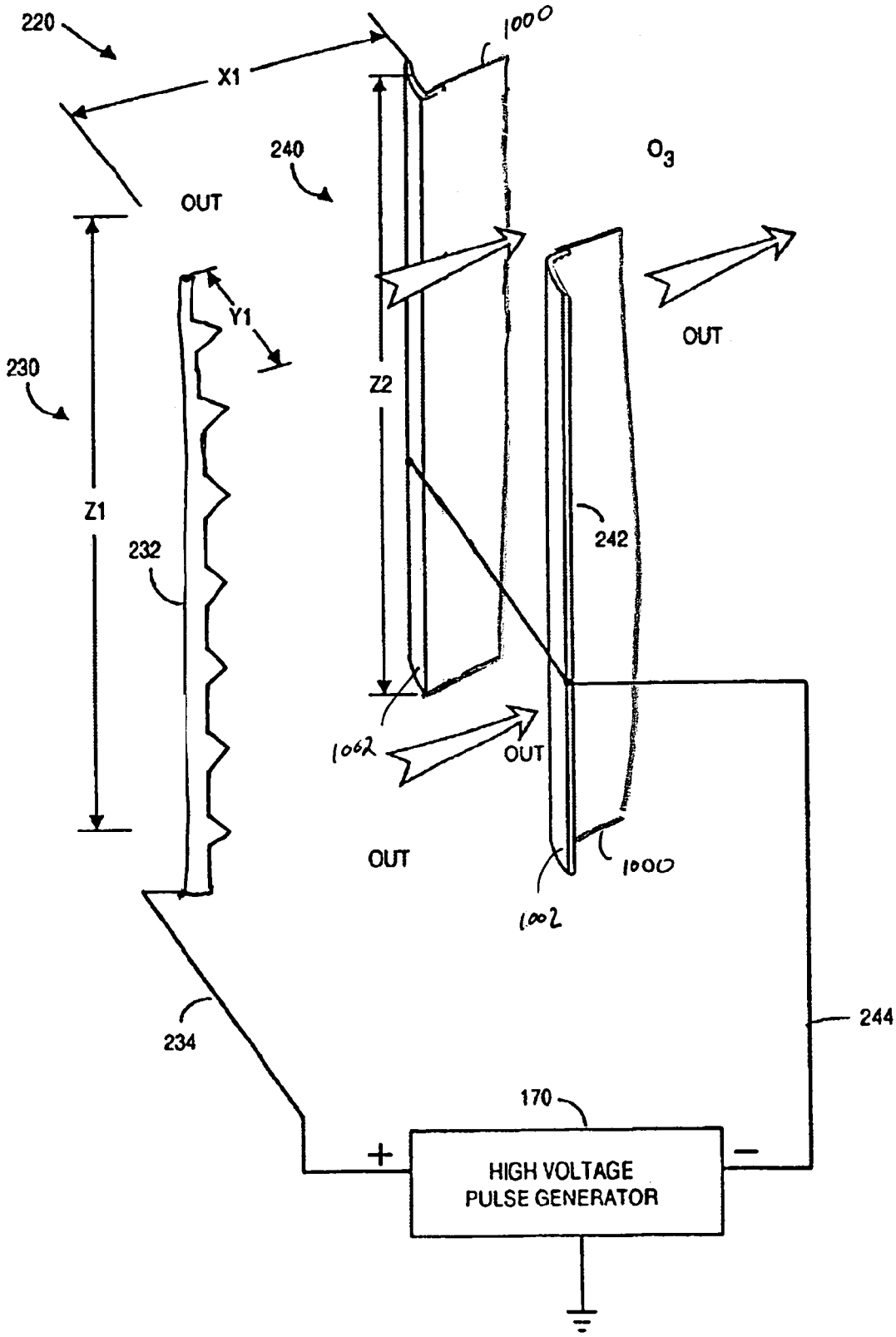
FIG. 4L is a perspective block diagram showing an example embodiment for an electrode assembly, according to the present invention.

FIG. 4L illustrates yet another embodiment. This embodiment is the same as the embodiment of FIGS. 4E and 4F described above except that the emitter electrode 232 has as saw tooth shape and the portions 1000 of the L-shaped collector electrodes 242 extending away from the emitter electrode 232 are longer than the portions 1002 of the L shaped collector electrodes 242 extending perpendicular to the emitter electrode 232.

Figure 5A:
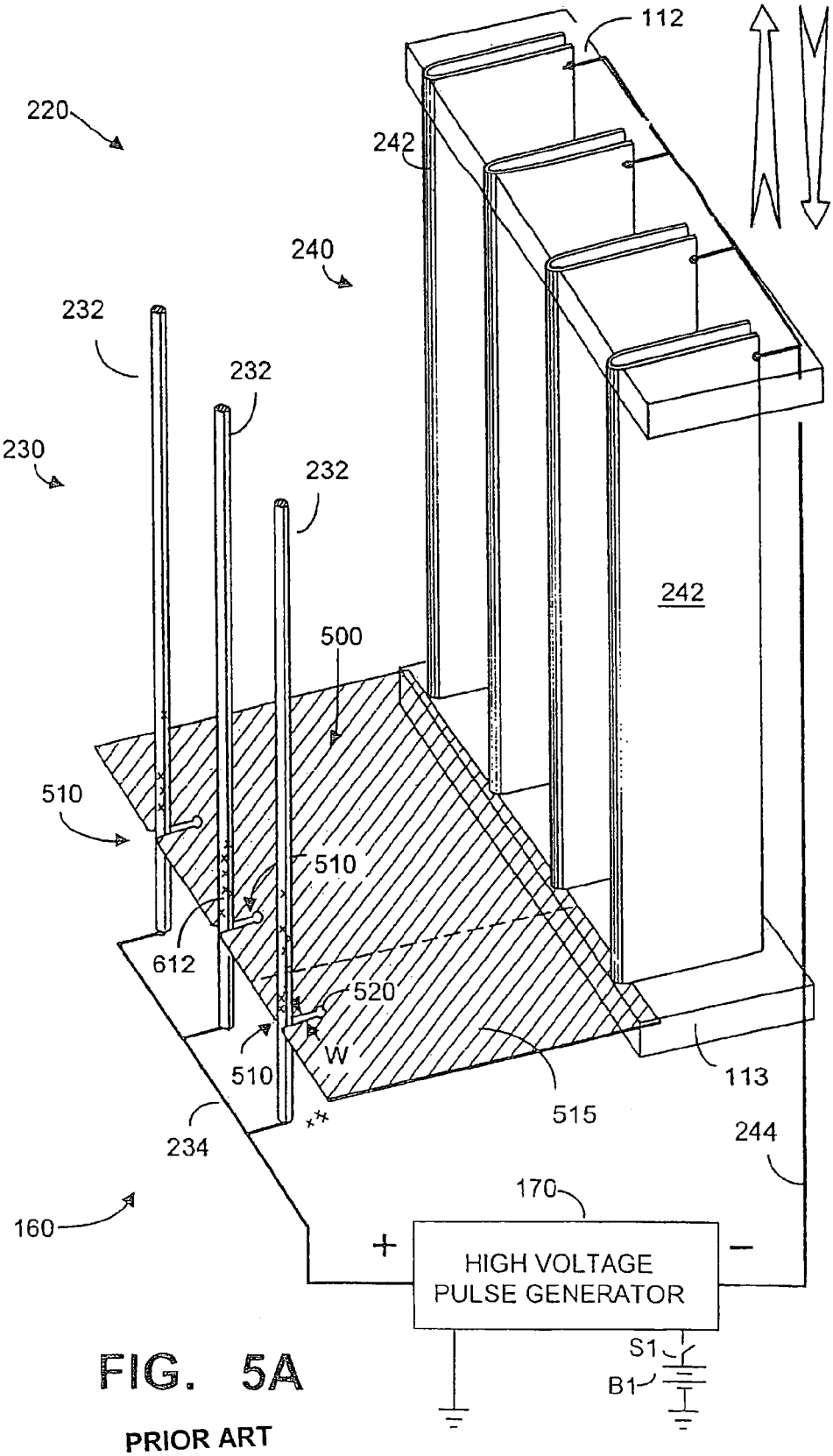
FIG. 5A PRIOR ART
FIG. 5A is a perspective view of an prior art electrode assembly depicting a mechanism to clean first electrode array electrodes usable with current example embodiments.

Turning now to FIG. 5A, a first embodiment of an electrode cleaning mechanism 500 is depicted. In the embodiment shown, mechanism 500 comprises a flexible sheet of insulating material such as MYLAR or other high voltage, high temperature breakdown resistant material, having sheet thickness of perhaps 0.1 mm or so. Sheet 500 is attached at one end to the base or other mechanism 113 secured to the lower end of second electrode array 240. Sheet 500 extends or projects out from base 113 towards and beyond the location of first electrode array 230 electrodes 232. The overall projection length of sheet 500 in FIG. 5A will be sufficiently long to span the distance between base 113 of the second array 240 and the location of electrodes 232 in the first array 230. This span distance will depend upon the electrode array configuration but typically will be a few centimeters or so. The distal edge of sheet 500 will extend slightly beyond the location of electrodes 232, perhaps 0.5" (12 mm) beyond. As shown in FIGS. 5A and 5C, the distal edge, e.g., edge closest to electrodes 232, of material 500 is formed with a slot 510 corresponding to the location of an electrode 232. The inward end of the slot forms a small circle 520, which can promote flexibility.

The configuration of material 500 and slots 510 is such that each wire or wire-like electrode 232 in the first electrode array 230 fits snugly and frictionally within a corresponding slot 510. As indicated by FIG. 5A and shown in FIG. 5C, instead of a single sheet 500 that includes a plurality of slots 510, one can provide individual strips 515 of material 500, the distal end of each strip having a slot 510 that will surround an associated wire electrode 232. Note in FIGS. 5B and 5C that sheet 500 or sheets 515 may be formed with holes 119 that can attach to pegs 117 that project from the base portion 113 of the second electrode array 240. Of course other attachment mechanisms could be used including glue, double-sided tape, inserting the array 240—facing edge of the sheet into a horizontal slot or ledge in base member 113, and so forth.

FIG. 5A shows second electrode array 240 in the process of being moved upward, perhaps by a user intending to remove array 240 to remove particulate matter from the surfaces of its electrodes 242. Note that as array 240 moves up (or down), sheet 510 (or sheets 515) also move up (or down). This vertical movement of array 240 produces a vertical movement in sheet 510 or 515, which causes the outer surface of electrodes 232 to scrape against the inner surfaces of an associated slot 510. FIG. 5A, for example, shows debris and other deposits 612 (indicated by x's) on wires 232 above sheet 500. As array 240 and sheet 500 move upward, debris 612 is scraped off the wire electrodes, and falls downward (to be vaporized or collected as particulate matter when unit 100 is again reassembled and turned-on). Thus, the outer surface of electrodes 232 below sheet 500 in FIG. 5A is shown as being cleaner than the surface of the same electrodes above sheet 500, where scraping action has yet to occur.

A user hearing that excess noise or humming emanates from unit 100 might simply turn the unit off, and slide array 240 (and thus sheet 500 or sheets 515) up and down (as indicated by the up/down arrows in FIG. 5A) to scrape the wire electrodes in the first electrode array. This technique does not damage the wire electrodes, and allows the user to clean as required.

As noted earlier, a user may remove second electrode array 240 for cleaning (thus also removing sheet 500, which will have scraped electrodes 232 on its upward vertical path). If the user cleans electrodes 242 with water and returns array 240 to unit 100 without first completely drying 240, moisture might form on the upper surface of a horizontally disposed member 550 within unit 100. Thus, as shown in FIG. 5N, an upwardly projecting vane 560 may be disposed near the base of each electrode 232 such that when array 240 is fully inserted into unit 100, the distal portion of sheet 500 or sheet strips 515 deflect upward. While sheet 500 or sheets 515 nominally will define an angle of about 90°, as base 113 becomes fully inserted into unit 100, the angle will increase, approaching 0°, e.g., the sheet is extending almost vertically upward. If desired, a portion of sheet 500 or sheet strips 515 may be made stiffer by laminating two or more layers of MYLAR or other material. For example the distal tip of strip 515 in FIG. 5B might be one layer thick, whereas the half or so of the strip length nearest electrode 242 might be stiffened with an extra layer or two of Mylar or similar material.

Figure 5B:
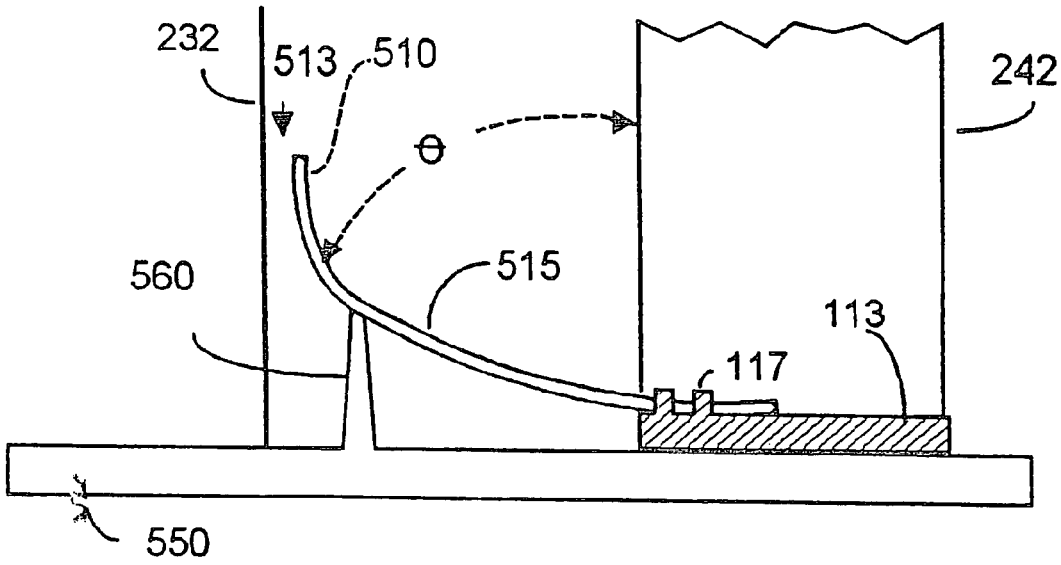
FIG. 5B PRIOR ART
FIG. 5B is a side view depicting an electrode cleaning mechanism as shown in FIG. 5A.
Figure 5C:
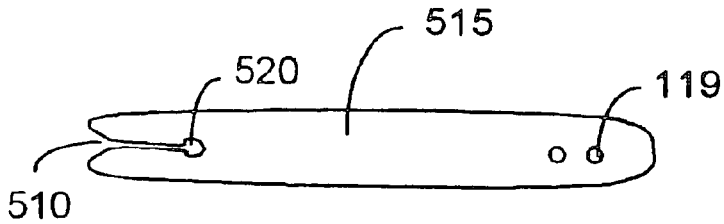
FIG. 5C PRIOR ART
FIG. 5C is a plan view of the electrode cleaning mechanism shown in FIG. 5B.

The inclusion of a projecting vane 560 in the configuration of FIG. 5B advantageously disrupted physical contact between sheet 500 or sheet strips 515 and electrodes 232, thus tending to preserve a high ohmic impedance between the first and second electrode arrays 230, 240. The embodiment of FIGS. 6A-6D advantageously serves to pivot sheet 500 or sheet strips 515 upward, essentially parallel to electrodes 232, to help maintain a high impedance between the first and second electrode arrays. Note the creation of an air gap 513 resulting from the upward deflection of the slit distal tip of strip 515 in FIG. 5B.

Figure 6A:
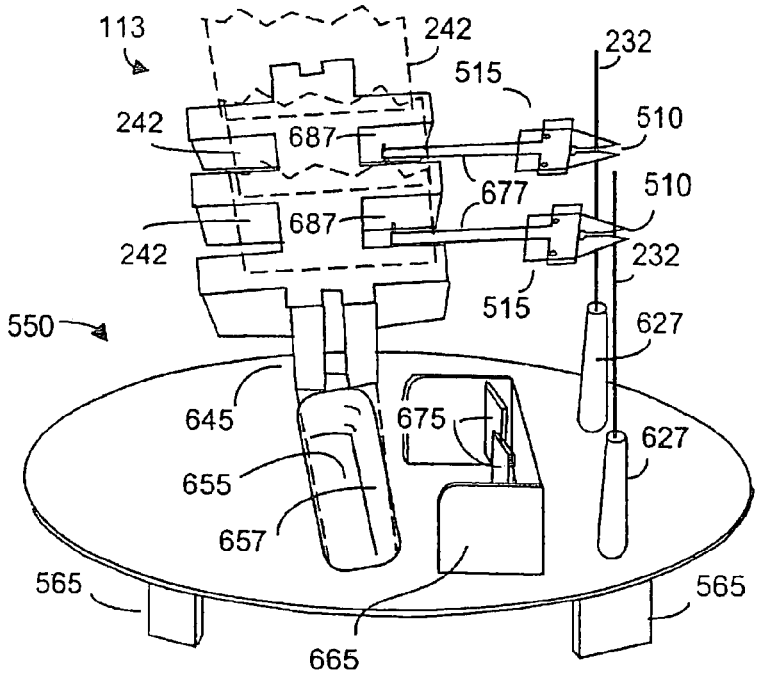
FIG. 6A PRIOR ART
FIG. 6A is a perspective view of a prior art pivotable electrode cleaning mechanism usable with current example embodiments.

In FIG. 6A, the lower edges of second array electrodes 242 are retained by a base member 113 from which project arms 677, which can pivot about pivot axle 687. The axle 687 biases arms 677 into a horizontal disposition, e.g., such that the angle is about 90°. Arms 645 project from the longitudinal axis of base member 113 to help member 113 align itself within an opening 655 formed in member 550, described below. The base member 113 and arms 677 are formed from a material that exhibits high voltage breakdown and can withstand high temperature. Ceramic is one material, but certain plastics could also be used. The unattached tip of each arm 677 terminates in a sheet strip 515 of MYLAR, KAPTON, or a similar material, whose distal tip terminates in a slot 510. It is seen that the pivotable arms 677 and sheet strips 515 are disposed such that each slot 510 will self-align with a wire or wire-like electrode 232 in first array 230. Electrodes 232 extend from pylons 627 on a base member 550 that extends from legs 565 from the internal bottom of the housing of the transporter-conditioner unit. To further help maintain high impedance between the first and second electrode arrays, base member 550 includes a barrier wall 665 and upwardly extending vanes 675. Vanes 675, pylons 627, and barrier wall 665 extend upward perhaps an inch or so, depending upon the configuration of the two electrodes, and can be formed integrally, e.g., by casting, from a material that exhibits high voltage breakdown and can withstand high temperature, ceramic, or certain plastics for example.

Figure 6B:
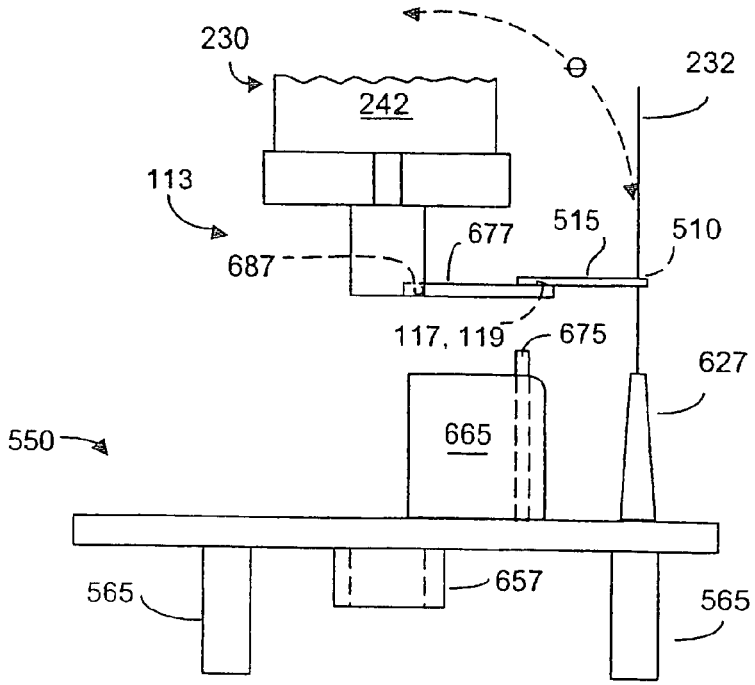
FIG. 6B PRIOR ART
FIGS. 6B-6D depict the cleaning mechanism of FIG. 6A in various positions.

As best seen in FIG. 6A, base member 550 includes an opening 655 sized to receive the lower portion of second electrode array base member 113. In FIGS. 6A and 6B, arms 677 and sheet material 515 are shown pivoting from base member 113 about axis 687 at an angle of about 90°. In this disposition, an electrode 232 will be within the slot 510 formed at the distal tip of each sheet material member 515.

Assume that a user had removed second electrode array 240 completely from the transporter-conditioner unit for cleaning, and that FIGS. 6A and 6B depict array 240 being reinserted into the unit. The coiled spring or other bias mechanism associated with pivot axle 687 will urge arms 677 into an approximately 90° angle orientation as the user inserts array 240 into unit 100. Side projections 645 help base member 113 align properly such that each wire or wire-like electrode 232 is caught within the slot 510 of a member 515 on an arm 677. As the user slides array 240 down into unit 100, there will be a scraping action between the portions of sheet member 515 on either side of a slot 510, and the outer surface of an electrode 232 that is essentially captured within the slot. This friction will help remove debris or deposits that may have formed on the surface of electrodes 232. The user may slide array 240 up and down the further promote the removal of debris or deposits from elements 232.

Figure 6C:
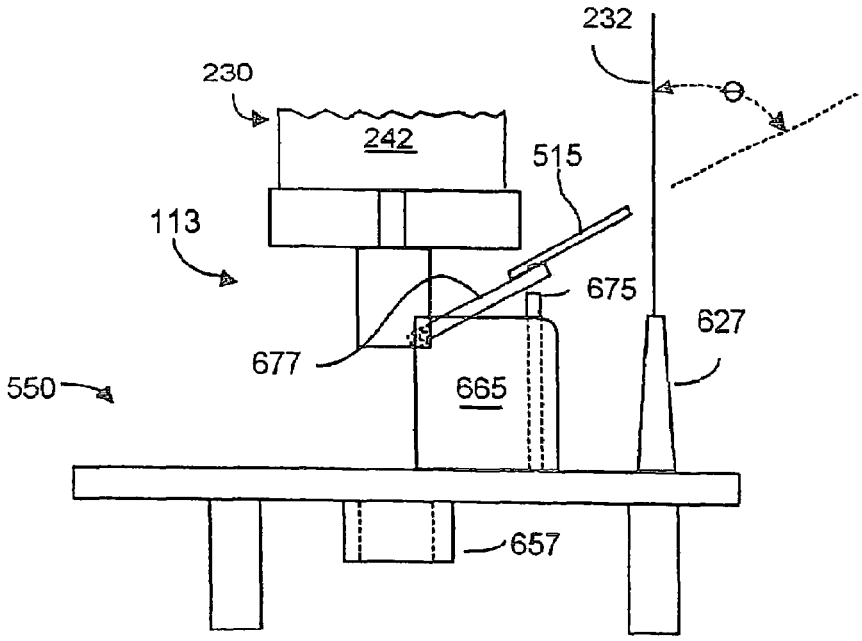
FIG. 6C PRIOR ART

In FIG. 6C the user has slid array 240 down almost entirely into unit 100. In the embodiment shown, when the lowest portion of base member 232 is perhaps an inch or so above the planar surface of member 550, the upward edge of a vane 675 will strike the a lower surface region of a projection arm 677. The result will be to pivot arm 677 and the attached slit-member 515 about axle 687 such that the angle decreases. In the configuration shown in FIG. 6C, the angle is about 45° and slit-contact with an associated electrode 232 is no longer made.

Figure 6D:
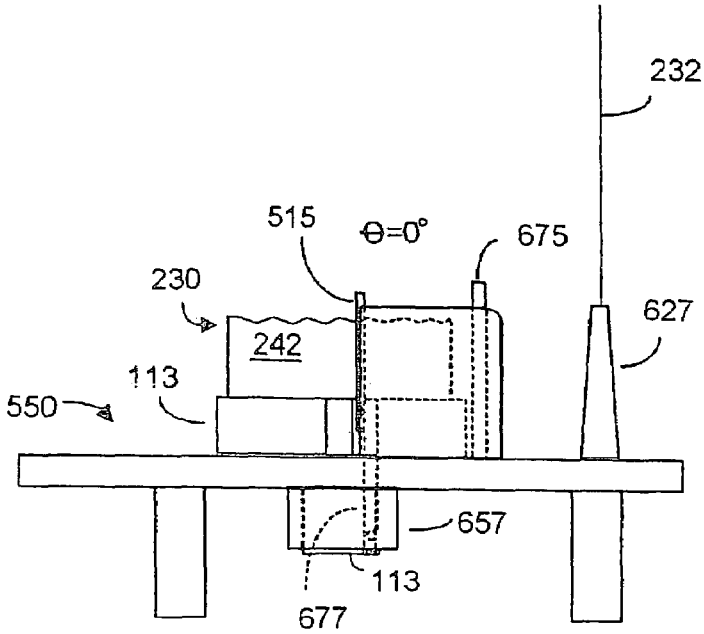
FIG. 6D PRIOR ART

In FIG. 6D, the user has firmly urged array 240 fully downward into transporter-conditioner unit 100. In this disposition, as the projecting bottommost portion of member 113 begins to enter opening 655 in member 550 (see FIG. 6A), contact between the inner wall 657 portion of member 550 urges each arm 677 to pivot fully upward, e.g., an angle of about 0°. Thus in the fully inserted disposition shown in FIG. 6D, each slit electrode cleaning member 515 is rotated upward parallel to its associated electrode 232. As such, neither arm 677 nor member 515 will decrease impedance between first and second electrode arrays 230, 240. Further, the presence of vanes 675 and barrier wall 665 further promote high impedance.

Thus, the embodiments shown in FIGS. 5A-6D depict alternative configurations for a cleaning mechanism for a wire or wire-like electrode in a transporter-conditioner unit.

Figures 7A, 7B, 7C, 7D, 7E:
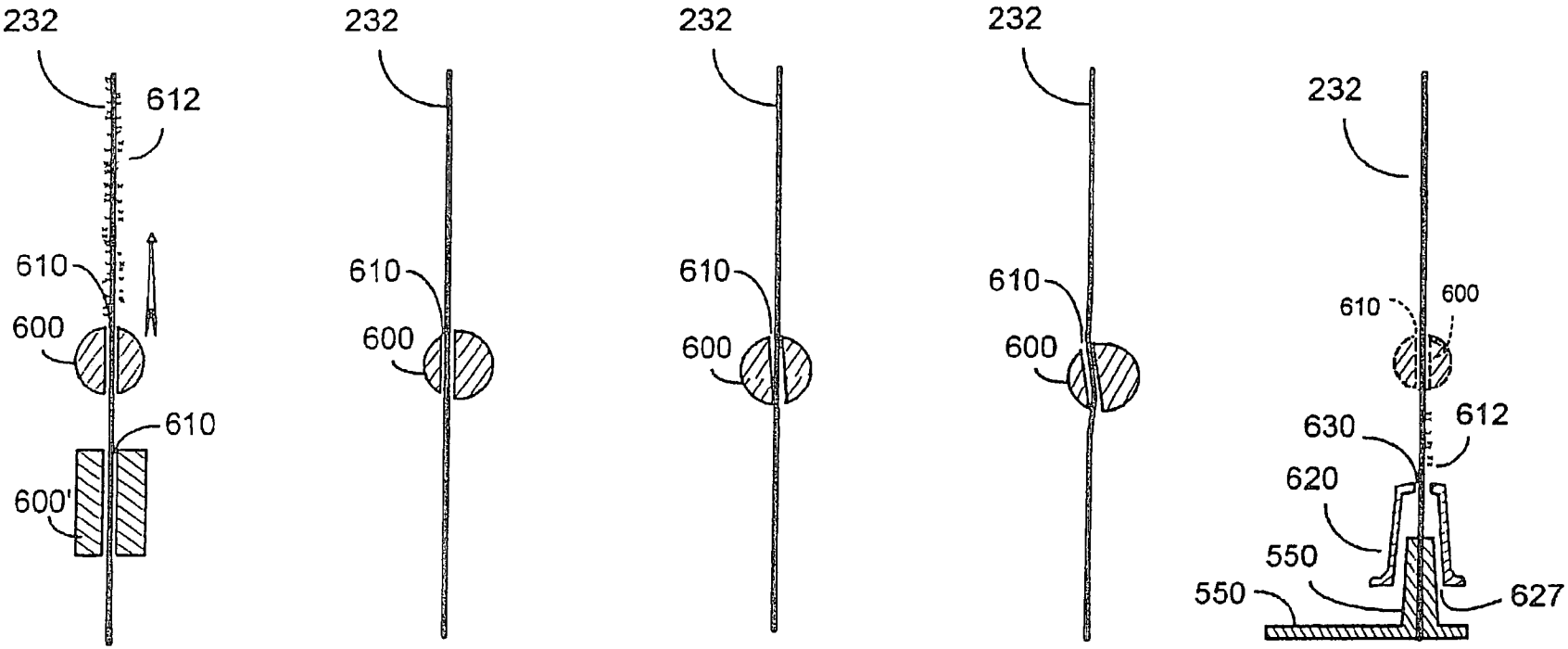
FIG. 7A PRIOR ART
FIG. 7B PRIOR ART
FIG. 7C PRIOR ART
FIG. 7D PRIOR ART
FIG. 7E PRIOR ART
FIGS. 7A-7E depict cross-sectional views of prior art bead-like mechanisms to clean first electrode array electrodes usable with current example embodiments.

Turning now to FIGS. 7A-7E, various bead-like mechanisms are shown for cleaning deposits from the outer surface of wire electrodes 232 in a first electrode array 230 in a transporter-converter unit. In FIG. 7A a symmetrical bead 600 is shown surrounding wire element 232, which is passed through bead channel 610 at the time the first electrode array is fabricated. Bead 600 is fabricated from a material that can withstand high temperature and high voltage, and is not likely to char, ceramic or glass, for example. While a metal bead would also work, an electrically conductive bead material would tend slightly to decrease the resistance path separating the first and second electrode arrays, e.g., by approximately the radius of the metal bead. In FIG. 7A, debris and deposits 612 on electrode 232 are depicted as "x's." In FIG. 7A, bead 600 is moving in the direction shown by the arrow relative to wire 232. Such movement can result from the user inverting unit 100, e.g., turning the unit upside down. As bead 600 slides in the direction of the arrow, debris and deposits 612 scrape against the interior walls of channel 610 and are removed. The removed debris can eventually collect at the bottom interior of the transporter-conditioner unit. Such debris will be broken down and vaporized as the unit is used, or will accumulate as particulate matter on the surface of electrodes 242. If wire 232 has a nominal diameter of say 0.1 mm, the diameter of bead channel 610 will be several times larger, perhaps 0.8 mm or so, although greater or lesser size tolerances may be used. Bead 600 need not be circular and may instead be cylindrical as shown by bead 600' in FIG. 7A. A circular bead may have a diameter in the range of perhaps 0.3" (8 mm) to perhaps 0.5" (12 mm). A cylindrical bead might have a diameter of say 0.3" (8 mm) and be about 0.5" (12 mm) tall, although different sizes could of course be used.

As indicated by FIG. 7A, an electrode 232 may be strung through more than one bead 600, 600'. Further, as shown by FIGS. 7B-7D, beads having different channel symmetries and orientations may be used as well. It is to be noted that while it may be most convenient to form channels 610 with circular cross-sections, the cross-sections could in fact be non-circular, e.g., triangular, square, irregular shape, etc.

FIG. 7B shows a bead 600 similar to that of FIG. 7A, but wherein channel 610 is formed off-center to give asymmetry to the bead. An off-center channel will have a mechanical moment and will tend to slightly tension wire electrode 232 as the bead slides up or down, and can improve cleaning characteristics. For ease of illustration, FIGS. 7B-7E do not depict debris or deposits on or removed from wire or wire-like electrode 232. In the embodiment of FIG. 7C, bead channel 610 is substantially in the center of bead 600 but is inclined slightly, again to impart a different frictional cleaning action. In the embodiment of FIG. 7D, beam 600 has a channel 610 that is both off center and inclined, again to impart a different frictional cleaning action. In general, asymmetrical bead channel or through-opening orientations are preferred.

FIG. 7E depicts an embodiment in which a bell-shaped walled bead 620 is shaped and sized to fit over a pillar 550 connected to a horizontal portion 560 of an interior bottom portion of unit 100. Pillar 550 retains the lower end of wire or wire-like electrode 232, which passes through a channel 630 in bead 620, and if desired, also through a channel 610 in another bead 600. Bead 600 is shown in phantom in FIG. 7E to indicate that it is optional.

Friction between debris 612 on electrode 232 and the mouth of channel 630 will tend to remove the debris from the electrode as bead 620 slides up and down the length of the electrode, e.g., when a user inverts transporter-conditioner unit 100, to clean electrodes 232. It is understood that each electrode 232 will include its own bead or beads, and some of the beads may have symmetrically disposed channels, while other beads may have asymmetrically disposed channels. An advantage of the configuration shown in FIG. 7E is that when unit 100 is in use, e.g., when bead 620 surrounds pillar 550, with an air gap there between, improved breakdown resistance is provided, especially when bead 620 is fabricated from glass or ceramic or other high voltage, high temperature breakdown material that will not readily char. The presence of an air gap between the outer surface of pillar 550 and the inner surface of the bell-shaped bead 620 helps increase this resistance to high voltage breakdown or arcing, and to charring.

Figure 8:
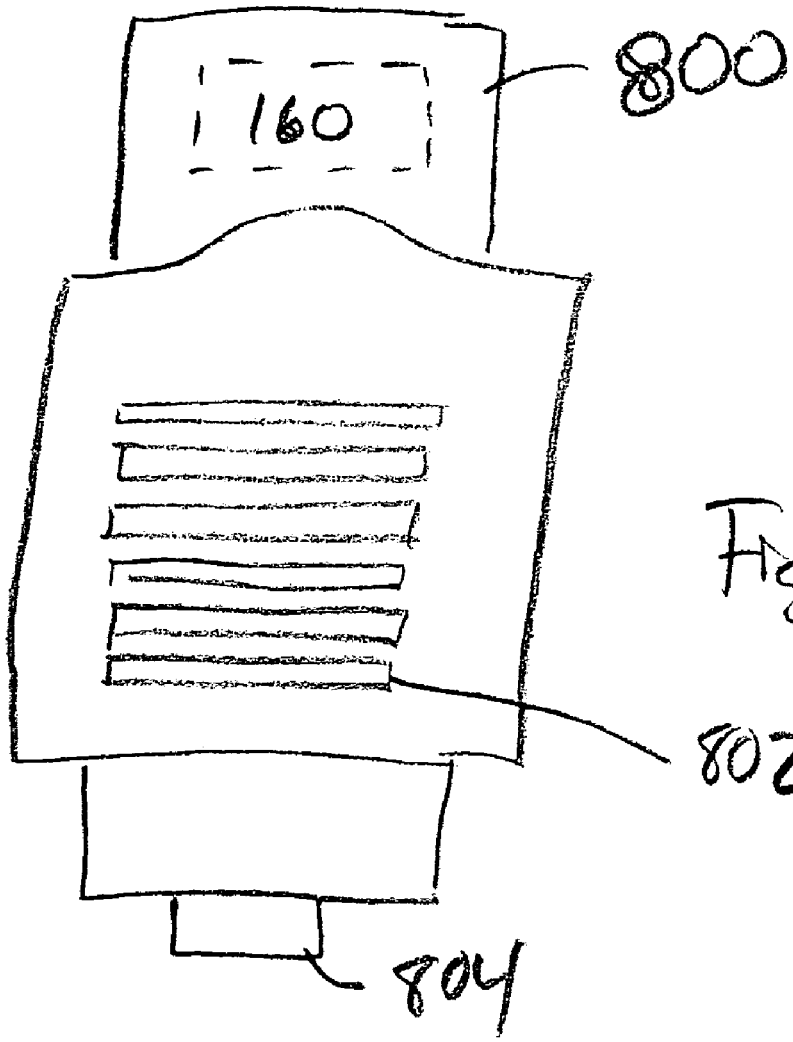
FIGS. 8 and 9 illustrates an electro-kinetic air transporter-conditioner or ionic air conditioning system according to another embodiment of the present invention.
Figure 9:
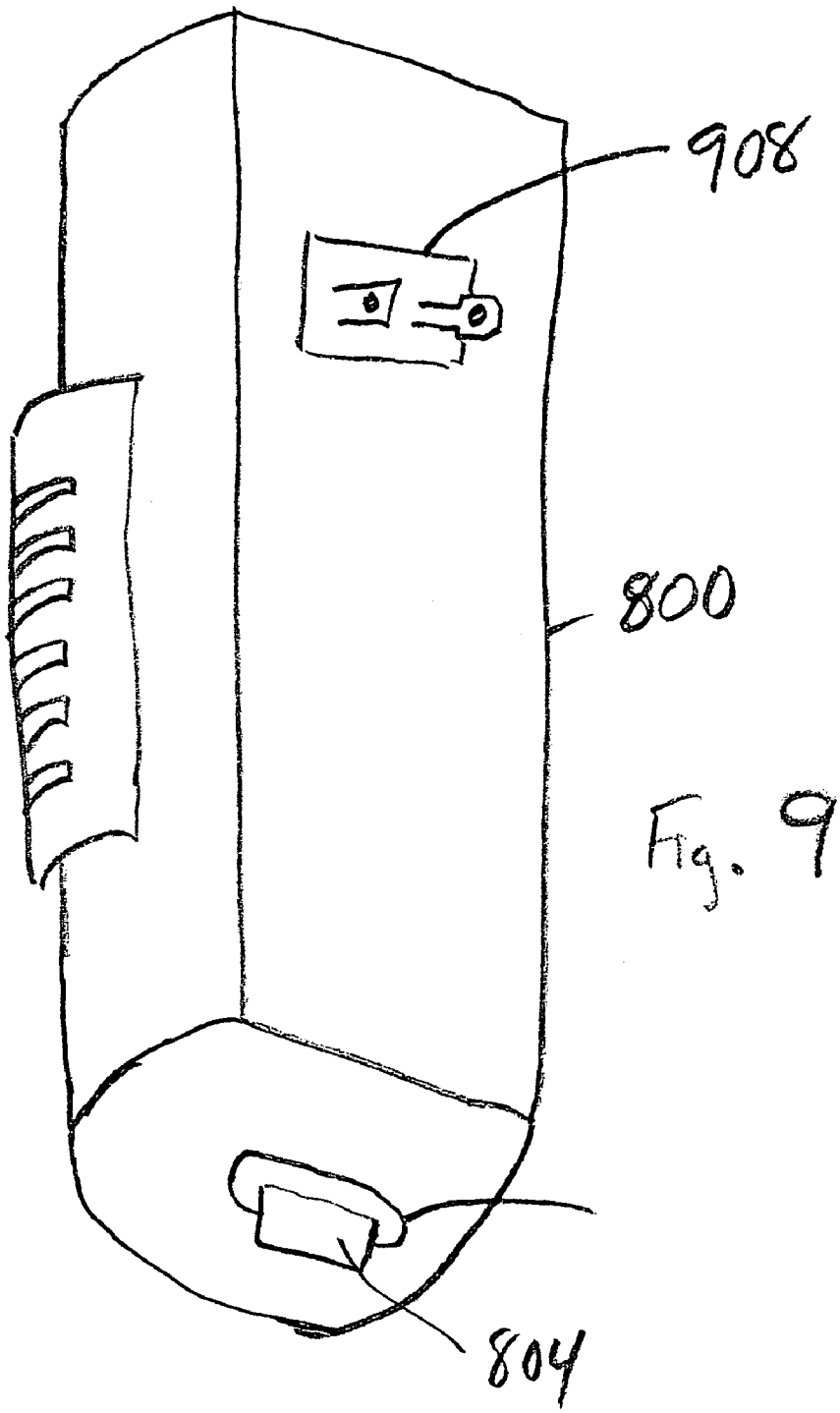

FIGS. 8 and 9 illustrates an electro-kinetic air transporter-conditioner or ionic air conditioning system according to another embodiment of the present invention. More particularly, FIG. 8 illustrates a front view of the ionic air conditioner and FIG. 9 illustrates a rear perspective view of the ionic air conditioner. Unlike the upstanding ionic air conditioning system of FIGS. 2A and 2B, this embodiment is not free-standing, but instead, mounts to a wall outlet as will be described in detail below.

As shown in FIG. 8, the ionic air conditioning system includes a housing 800 having vents 802 that allow for air to flow into and out of an interior of the housing 800. The housing 800 includes, in an interior portion thereof, the high voltage generator 160 for generating a constant or pulsed voltage as described above. For the purposes of explanation, it will be assumed that a the high voltage generator 160 generates a constant voltage.

As shown in FIG. 9, a polarized plug 908 is disposed on back surface of the housing 800. The polarized plug 908 will only engage with a conventional wall outlet and support the housing if the handle 804 shown in FIGS. 8 and 9 (and described in more detail below) points in a downward direction. The polarized plug 908 transfers electric power from the wall outlet to the high voltage generator 160. While the polarized plug 908 has been depicted according to standards in use in the United States, it will be understood that the plug could be reconfigured for use of the air conditioner unit in countries operating according to other standards.

The housing 800 also includes an emitter and collector electrode arrangement such as illustrated in any of FIGS. 4A-4L that is connected to the high voltage generator 160. Because the embodiment of FIG. 8 is a smaller wall mounted unit as opposed to the free standing unit of FIGS. 2A and 2B, it will be understood that the number of emitter and collector electrodes 232 and 242 may be less than provided in the embodiments of FIGS. 4A-4L. It will also be understood that the dimensions of the emitter and collector electrodes 232 and 242 will be such as to fit within the interior of the housing 800, and that the high voltage generator 160 may not need to generate a voltage as high as set forth in the description above. For the purposes of explanation only, the embodiment of FIG. 8 will be described as including the emitter and collector electrode arrangement of FIG. 4L.

Figure 10:
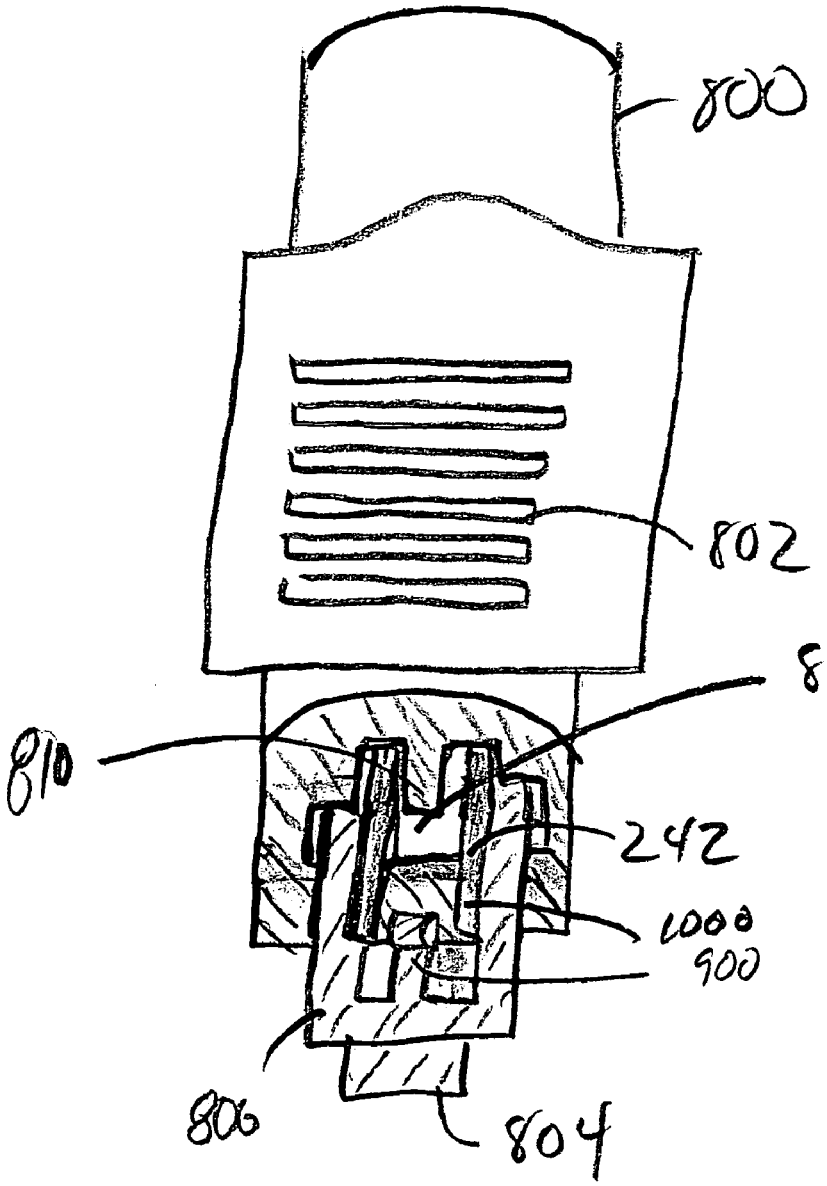
FIG. 10 illustrates a front perspective view of the ionic air conditioner with the collector electrodes partially removed from the housing.

FIG. 10 illustrates a front perspective view of the ionic air conditioner with the collector electrodes 242 partially removed from the housing 800. As shown, the handle 804 is connected to the L-shaped collector electrodes 242. More specifically, the handle 804 forms part of a frame 806 to which the collector electrodes 242 are mounted. By grabbing and pulling on the handle 804, the collector electrode 242 may be removed through a hole 808 in the bottom surface of the housing 800. As will be appreciated, because the collector electrodes 242 are removed from the bottom surface of the housing 800, gravity will assist in their removal. Once removed, the collector electrodes 242 may then be cleaned. Using the handle 806 again, the collector electrodes 242 may be reinserted into the housing 800. A catch 900 is provided on the frame 806 for engaging with a tab 810 when the collector electrodes 242 are inserted into the housing 800 to prevent the collector electrodes 242 from falling out of the housing 800.

As will be appreciated from the position of the collector electrodes 242 depicted in FIG. 10 and the electrode arrangement depicted in FIG. 4L, the collector electrodes 242 are disposed closer to the vents 802 than the emitter electrode 232 and the portions 1000 of the collector electrodes 242 extending away from the emitter electrode 232 extend towards the vents 802.

Figure 11:
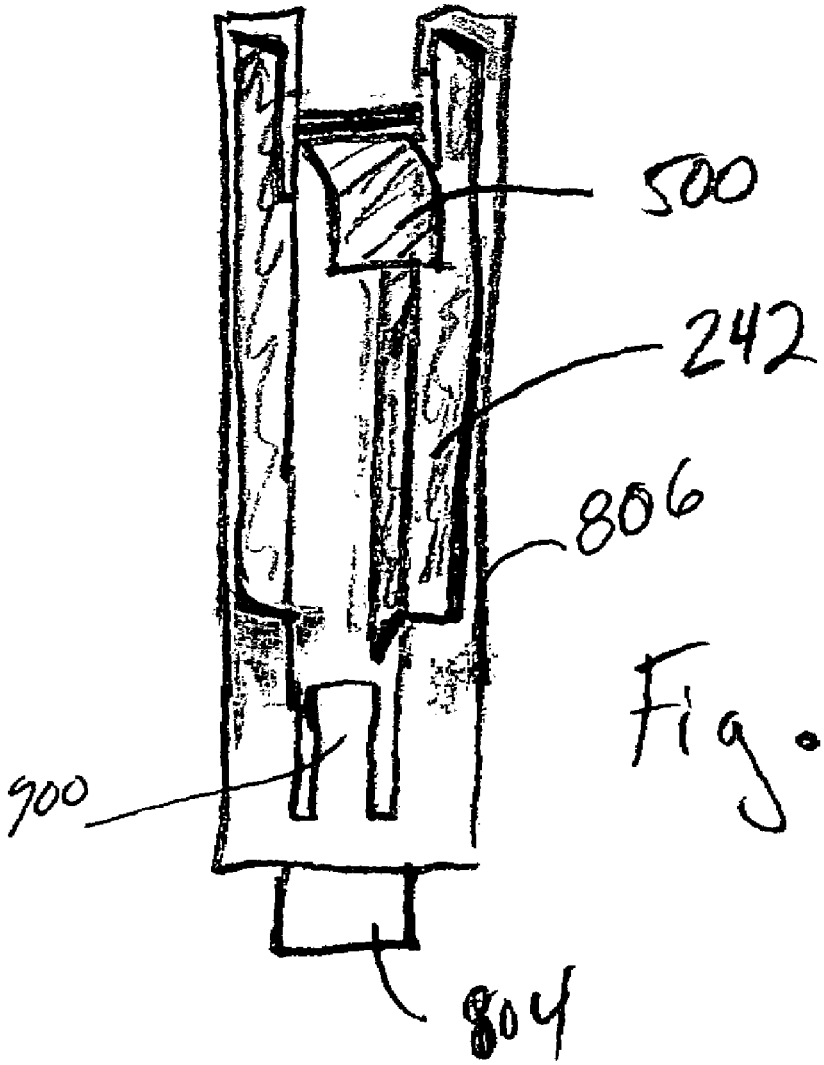
FIG. 11 illustrates a rear perspective view of the entire frame shown in FIG. 10.

FIG. 11 illustrates a rear perspective view of the entire frame 806. As shown, the collector electrodes 242 are attached to the frame 806. This may be accomplished using adhesive or plastic rivets. In addition, FIG. 11 shows a flexible sheet 500 as discussed in previous embodiments, that serves to clean the emitter electrode 232 when the collector electrodes 242 are removed from the housing 800. In this embodiment, the flexible sheet 500 does not include a slit as in prior embodiments, but a slit could be provided.

Figure 12:
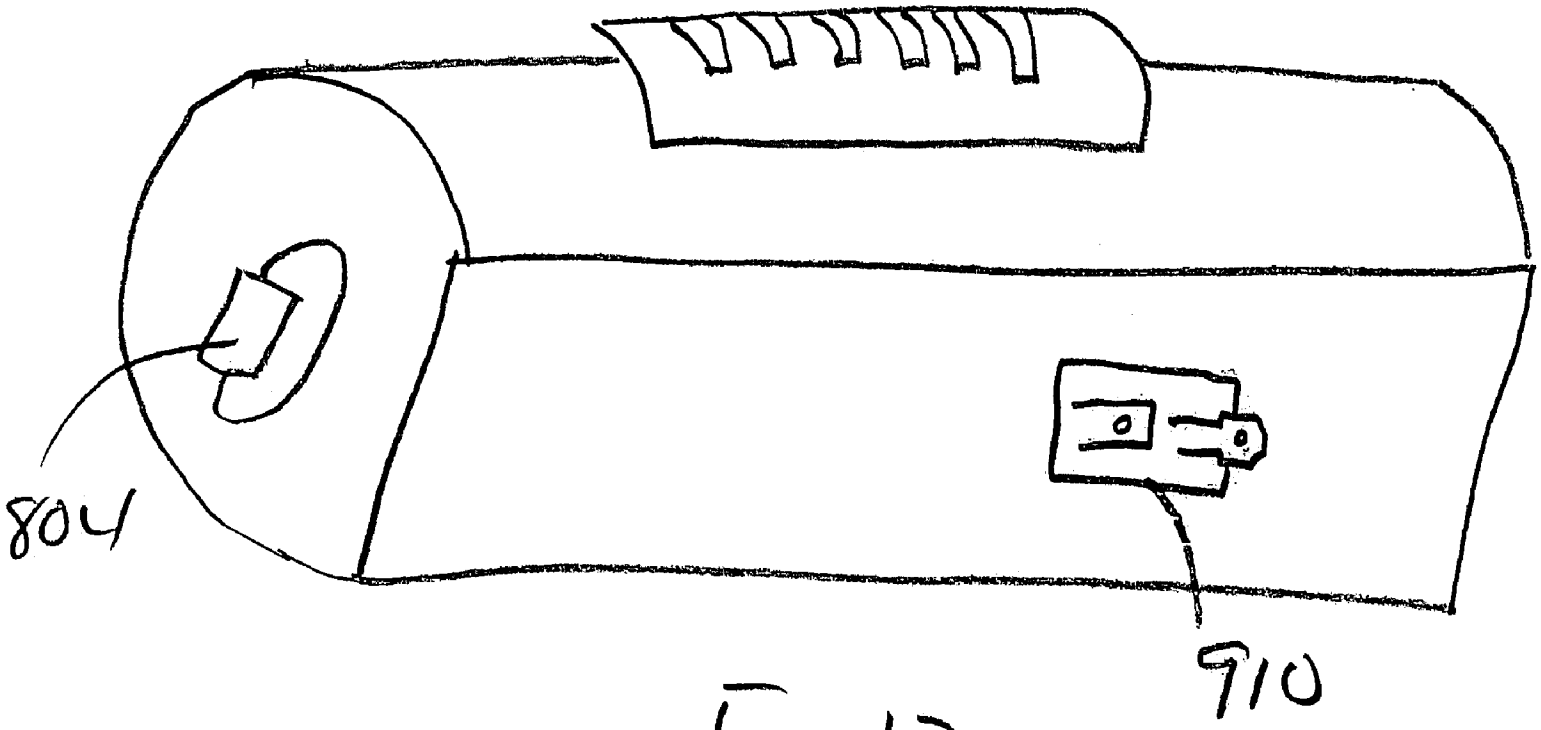
FIG. 12 illustrates yet another embodiment of an electro-kinetic air transporter-conditioner or ionic air conditioning system according to the present invention.

FIG. 12 illustrates yet another embodiment of an electro-kinetic air transporter-conditioner or ionic air conditioning system according to the present invention. The embodiment of FIG. 12 is the same as the embodiment of FIGS. 8-9, except for the polarized plug 910. In this embodiment, the polarized plug 910 is disposed on back surface of the housing 800 such that the polarized plug 910 will only engage with a conventional wall outlet and support the housing if the handle 804 shown in FIG. 11 points in a direction perpendicular to the ground. As such, the collector electrodes 242 in this embodiment are removable and returnable through a side surface of the housing 800.

The invention being thus described, it will be obvious that the same may be varied in many ways. For example, while the embodiments described above concerned the EDCH in a UMTS wireless communication system, the present invention is not limited in application to this channel or a UMTS system. Such variations are not to be regarded as a departure from the invention, and all such modifications are intended to be included within the scope of the invention.

What is claimed:

1. An air conditioning system, comprising:

a housing having a vent portion;

an ion generating unit positioned in the housing and including, a first electrode, at least one second electrode having an L-shaped cross-section such that a first portion of the second electrode extends perpendicular to the first electrode and a second portion of the second electrode extends parallel to the first electrode and is longer than the first portion to define the L shaped cross-section, and a voltage generator that provides a constant potential difference between the first electrode and the second electrode; and wherein the second electrode is removable through a bottom surface of the housing from a resting position within the housing to a location external to the housing; and the second electrode is returnable through the bottom surface of the housing.

2. The air conditioning system of claim 1, wherein the second electrode is removable through a bottom surface of the housing from a resting position within the housing to a location external to the housing such that gravity assists with removing the second electrode.

3. The air conditioning system of claim 2, wherein the ion generating unit includes two second electrodes, each of the second electrodes having an L shaped cross-section.

4. The air conditioning system of claim 3, wherein a first portion of each second electrode extends perpendicular to the first electrode and a second portion of each second electrode extends away from the first electrode to define the L shaped cross-section.

5. The air conditioning system of claim 4, wherein the two second electrodes are equidistant from the first electrode.

6. The air conditioning system of claim 2, further comprising:

a cleaning member attached to the second electrode that cleans the first electrode when the second electrode is removed from the housing.

7. The air conditioning system of claim 2, further comprising:

a handle connected to the second electrode, the handle extending out of the bottom surface of the housing to facilitate removal of the second electrode.

8. The air conditioning system of claim 1, wherein the second electrode is disposed closer to the vent portion than the first electrode.

9. The air conditioning system of claim 1, wherein the first electrode is an emitter electrode.

10. The air conditioning system of claim 1, wherein the first electrode is saw tooth shaped.

11. The air condition system of claim 1, further comprising:

a polarized plug attached to the housing for receiving electric power, the polarized plug supplying the voltage generator with power, the polarized plug supporting the housing when engaged with an electric power outlet and only being engagable with the electric power outlet when the bottom surface of the housing faces a downward direction.

12. An air conditioning system, comprising:

a housing having a vent portion;

an ion generating unit positioned in the housing and including, a saw toothed emitter electrode, two collector electrodes having an L shaped cross-section such that a first portion of each collector electrode extends perpendicular to the emitter electrode and a second portion of each collector electrode extends parallel to the emitter electrode and is longer than the first portion to define the L shaped cross-section, the two collector electrodes being equidistant from the emitter electrode and disposed closer to the vent than the emitter electrode, the collector electrodes being removable through a bottom surface of the housing from a resting position within the housing to a location external to the housing and being returnable through the bottom surface of the housing, a voltage generator that provides a constant potential difference between the first electrode and the second electrode, and a polarized plug attached to the housing for receiving electric power, the polarized plug supplying the voltage generator with power, the polarized plug supporting the housing when engaged with an electric power outlet and only being engagable with the electric power outlet when the bottom surface of the housing faces a downward direction.

13. An air conditioning system, comprising:

a housing having a vent portion;

an ion generating unit positioned in the housing and including, a first electrode, at least one second electrode having an L-shaped cross-section such that a first portion of the second electrode extends perpendicular to the first electrode and a second portion of the second electrode extends parallel to the first electrode and is longer than the first portion to define the L shaped cross-section, and a voltage generator that provides a constant potential difference between the first electrode and the second electrode; and wherein the second electrode is removable through a side surface of the housing from a resting position within the housing to a location external to the housing such that gravity does not assist with removing the second electrode; and the second electrode is returnable through the side surface of the housing such that gravity does not assist with returning the second electrode.

14. The air condition system of claim 13, further comprising:

a polarized plug attached to the housing for receiving electric power, the polarized plug supplying the voltage generator with power, the polarized plug supporting the housing when engaged with an electric power outlet and only being engagable with the electric power outlet when a bottom surface of the housing faces a downward direction.

* * * * *